US005546730A

United States Patent [19]

Newell et al.

[11] Patent Number: 5,546,730

[45] Date of Patent: Aug. 20, 1996

[54] METHOD AND APPARATUS FOR PLACING CORNER BOARDS AND STRETCH WRAPPING A LOAD

[75] Inventors: Gregory A. Newell, Louisville; Randy R. George, Lagrange; Patrick R. Lancaster, III; Robert D. Janes, both of Louisville, all of Ky.

[73] Assignee: Lantech, Inc., Louisville, Ky.

[21] Appl. No.: 220,592

[22] Filed: Mar. 31, 1994

[51] Int. Cl.[6] ..... B65B 13/04; B65B 53/00; B65B 61/00

[52] U.S. Cl. ..... 53/399; 53/410; 53/441; 53/139.7; 53/556; 53/587

[58] Field of Search ..... 53/399, 410, 139.7, 53/556, 587, 176, 449, 441

[56] References Cited

U.S. PATENT DOCUMENTS

| | | | |
|---|---|---|---|
| 2,896,207 | 7/1959 | Wilson . | |
| 3,241,287 | 3/1966 | Chundelak, Jr. . | |
| 3,271,925 | 9/1966 | Aubery . | |
| 3,378,987 | 4/1968 | Lems . | |
| 3,585,780 | 6/1971 | Elmore . | |
| 4,587,791 | 5/1986 | Brouse et al. . | |
| 4,700,530 | 10/1987 | Norberg . | |
| 4,897,980 | 2/1990 | Geyser et al. | 53/139.7 X |
| 5,161,349 | 11/1992 | Lancaster, III et al. . | |
| 5,226,280 | 7/1993 | Scherer et al. . | |

FOREIGN PATENT DOCUMENTS

| | | | |
|---|---|---|---|
| 2431153 | 1/1976 | Germany . | |
| 1210491 | 10/1970 | United Kingdom . | |
| WO92/08644 | 5/1992 | WIPO | 53/587 |

*Primary Examiner*—Linda Johnson

*Attorney, Agent, or Firm*—Finnegan, Henderson, Farabow, Garrett & Dunner L.L.P.

[57] ABSTRACT

A load having top and bottom caps is stretch wrapped at a wrapping station having turntable and a dispenser for dispensing stretch wrap packaging material, and a corner board placer for placing a corner board having tapered top and bottom edges on each corner of the load. With the load positioned on the turntable, the corner board placer is controlled by a controller to perform the steps of forming an acute angle between first and second portions of the corner board, and moving the corner board toward the corner until the first and second portions have been inserted between the top and bottom caps. The controller then causes the corner board placer to perform the steps of opening the corner board to substantially form a right angle, and simultaneously placing the first and second portions of the corner board proximate respective sides of the load by moving the corner board toward the corner in a direction oblique to the respective sides while maintaining the first and second portions generally parallel with the respective sides. A restrainer is provided for holding each corner board in place to allow subsequent corner board placement on another corner of the load. The turntable is rotated to wrap the load with the corner board placed on the corners of the load.

8 Claims, 17 Drawing Sheets

FIG. 2A
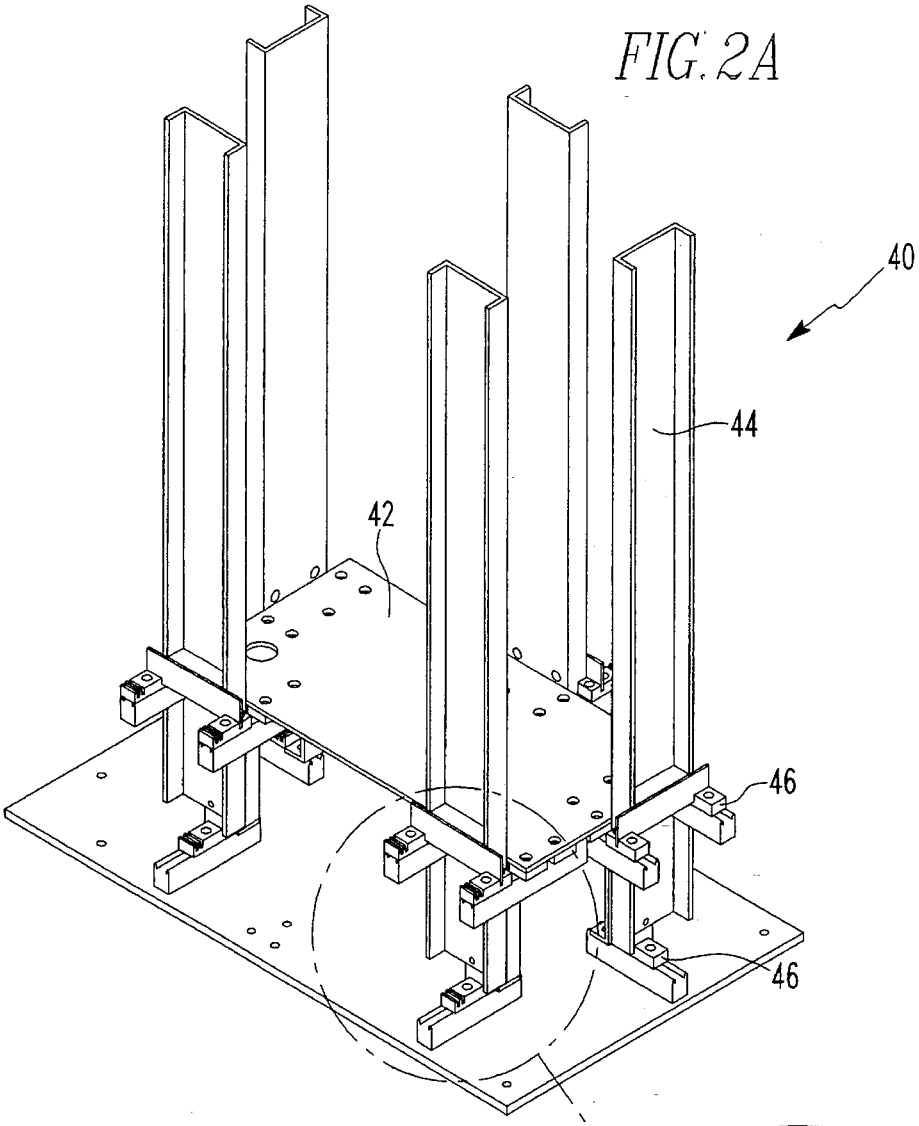
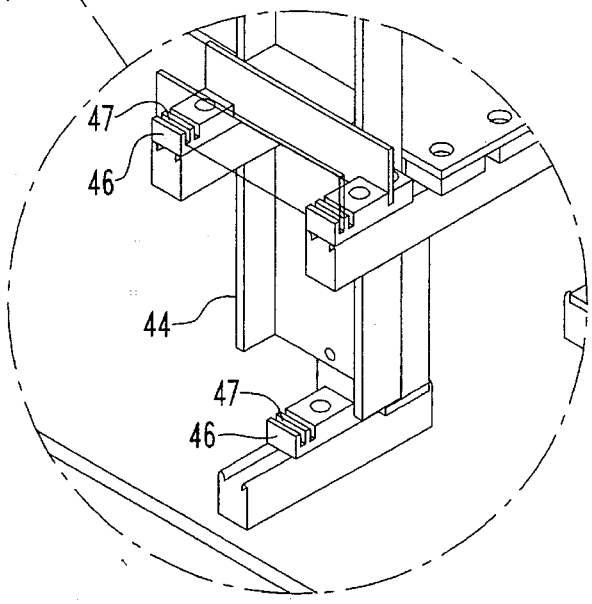
FIG. 2B

METHOD AND APPARATUS FOR PLACING CORNER BOARDS AND STRETCH WRAPPING A LOAD

BACKGROUND OF THE INVENTION

1. Field of the Invention

The present invention relates to a method and apparatus for placing corner boards, and stretch wrapping a load. In particular, the present invention is directed to automatically placing of corner boards on the vertical corners of a stacked lead having top and bottom caps, and wrapping stretch wrap packaging material around the lead while the corner boards are held in place.

2. Description of the Related Art

Products are often shipped and stored in cartons, which are stacked as a lead on a pallet to simplify handling of the cartons. The lead is commonly wrapped with stretch wrap packaging material to maintain the stacked configuration. To protect the lead during shipping and storage, particularly when the lead is fragile to indentation, top and bottom caps are provided on respective ends of the lead, and corner protectors are placed on the corners of the lead. Care must be taken so the lead is not damaged when positioning the protectors on the lead.

The positioning of the corner protectors is conventionally a time consuming and expensive process. If the process is performed manually, a corner protector must first be positioned and temporarily secured on each corner of the lead. The corner protector is temporarily secured using tape, straps, or hand wrap each corner of the load, a top cap is placed on the load. The load is then transported to a stretch wrapping machine for stretch wrapping.

Automated procedures also are available for positioning corner protectors on the corner of a load. These automated procedures generally require a top cap to be placed on the load after the corner protectors have been positioned, but before stretch wrapping has occurred.

In addition, these automated procedures generally store a number of preformed corner protectors vertically in a magazine, which can be difficult to load. The vertical magazine dispenses the preformed corner protector to a gripper placement device. In turn, the gripper placement device positions the preformed corner protector on a corner of the load by a series of positioning steps. It is recognized, however, that the preformed corner protectors may slip within the gripper placement device as it is removed from the vertical magazine, thereby creating a vertical misalignment between the corner protector and the corner.

Further, since the gripper placement device is used to maintain the corner protector in position until after stretch wrapping has been initiated, an overhead stretch wrapper is used to wrap the load. In such instances, it has been necessary to provide a separate gripper placement device for each corner of the load. The necessity of having four separate magazines and gripper placement devices is costly, both in available work space and intial investment expenses.

As such, there remains a need for an apparatus and method for reliably and efficiently placing corner boards on the corners of a load having top and bottom caps, and stretch wrapping the load with the corner boards in place, particularly in a way in which the load is not damaged during the application of the top and bottom caps, and the corner boards. Additionally, there remains a need for reducing the cost of an apparatus and method to place corner boards on a plurality of corners of a load.

SUMMARY OF THE INVENTION

The advantages and purpose of the invention will be set forth in part in the description that follows, and in part will be obvious from the description, or may be learned by practice of the invention. The advantages and purpose of the invention will be realized and attained by means of the elements and combinations particularly pointed out in the appended claims.

To achieve these advantages and in accordance with the purpose of the invention, as embodied and broadly described herein, one aspect of the present invention includes an apparatus for stretch wrapping a load including a wrapping station having a dispenser for dispensing stretch wrap packaging material, and a corner board placer for placing a corner board having a first portion and a second portion connected along a fold line on a corner of the load. A controller controls the corner board placer to place the corner board on the corner of the load that is oriented at a first corner placement position by moving the corner board toward the corner in a direction oblique to respective sides of the load that meet along the corner, while maintaining the first and second portions generally parallel with the respective sides of the load, to simultaneously place the first and second portions proximate the respective sides of the load. The apparatus also includes means for providing relative rotation between the load and the dispenser to wrap the stretch wrap packaging material around the load with the corner board placed on the corner of the load.

Additionally, and in accordance with another aspect of the present invention, the stretch wrapping apparatus also includes a restrainer for holding the corner board in place on the corner of the load while permitting the load to be rotated by the turntable. In this aspect of the invention, the controller controls the corner board placer, the turntable, and the restrainer, to rotate the turntable and sequentially orient a plurality of the corners of the load at the first corner board placement position, place a respective corner board on each of the plurality of the corners of the load at the first corner board placement position, and hold the respective corner boards in place on the plurality of the corners.

Further, and in accordance with another aspect of the present invention, an apparatus is provided for stretch wrapping a load having top and bottom caps with outwardly extending tabs. Each corner board to be placed on the corners of the load has a first portion and a second portion connected along a fold line and outer edges generally parallel to the fold line. Each of the first and second portions have a tapered top edge and a tapered bottom edge generally transverse to the fold line so the outer edges are shorter than the fold line.

The controller controls the corner board placer to form an acute angle between the first portion and the second portion, and moves the corner board toward the corner until the first and second portions have been inserted between the top and bottom caps so that the tapered top edges of the first and second portions are located directly below the outwardly extending tabs of the top cap and the tapered bottom edges of the first and second portions are located directly above the outwardly extending tabs of the bottom cap. The controller further controls the corner board placer to open the corner board to substantially form a right angle between the first and second portions, and place the corner board on the corner between the top and bottom caps with the first and second portions of the corner board placed proximate respective sides of the load.

Also in accordance with the purpose of the invention, another aspect of the present invention includes a method for stretch wrapping a load. The method includes the steps of positioning the load at a wrapping station including a dispenser for dispensing stretch wrap packaging material; supplying a corner board placer with a corner board having a first portion and a second portion connected along a fold line; and aligning the corner board so the fold line is parallel with a corner of the load and the first and second portions are spaced from and generally parallel with respective sides of the load that meet along the corner. The method further includes the steps of placing the corner board on the corner of the load by moving the corner board on the corner board placer toward the corner in a direction oblique to the respective sides of the load while maintaining the first and second portions generally parallel with the respective sides of the load to simultaneously place the first and second portions proximate the respective sides of the load. The method also includes the step of dispensing stretch wrap packaging material from the dispenser and providing relative rotation between the load and the dispenser to wrap the stretch wrap packaging material around the load with the corner board placed on the corner of the load.

Further, and in accordance with another aspect of the present invention, the method includes the steps of positioning the load on a turntable at the wrapping station and orienting a first corner of the load at a first corner board placement position; supplying a first corner board placer with a first corner board; placing the first corner board on the first corner of the load; holding the first corner board on the first corner of the load; rotating the turntable to orient a second corner of the load at the first corner board placement position; and then repeating the supplying, placing, and holding steps for a second corner board. Respective corner boards may be placed on additional corners of the load, either sequential to the placement of the first and second corner boards, or while the first and second corner boards are being placed on the load. The method concludes by dispensing stretch wrap packaging material from the dispenser and rotating the turntable to wrap the stretch wrap packaging material around the load with the corner boards placed on the corners of the load.

Another aspect of the present invention can be employed when using top and bottom caps having outwardly extending tabs. This aspect includes the steps of supplying a corner board placer with a corner board having a first portion and a second portion connected along a fold line, wherein each of the first and second portions has a tapered top edge and a tapered bottom edge generally transverse to the fold line so the outer edges are shorter than the fold line; forming an acute angle between the first portion and the second portion; and moving the corner board toward the corner until the first and second portions have been inserted between the top and bottom caps so that the tapered top edges of the first and second portions are located directly below the outwardly extending tabs of the top cap and the tapered bottom edges of the first and second portions are located directly above the outwardly extending tabs of the bottom cap. The method further includes opening the corner board to substantially form a right angle between the first and second portions; placing the corner board on the corner between the top and bottom caps with the first and second portions of the corner board placed proximate respective sides of the load; and dispensing stretch wrap packaging material from the dispenser and providing relative rotation between the load and the dispenser to wrap stretch wrap packaging material around the load with the corner board placed on the corner between the top and bottom caps.

It is to be understood that both the foregoing general description and the following detailed description are exemplary and explanatory only and are not restrictive to the invention, as claimed.

The accompanying drawings, which are incorporated in and constitute a part of the specification, illustrate embodiments of the invention and together with the description, serve to explain the principles of the invention.

BRIEF DESCRIPTION OF THE DRAWINGS

FIG. 2A is an enlarged perspective view of the loading station shown in FIG. 1.

FIG. 2B is an enlarged detail view of the slotted mounted block shown in FIG. 2A.

DESCRIPTION OF THE PREFERRED EMBODIMENTS

Figure 1:
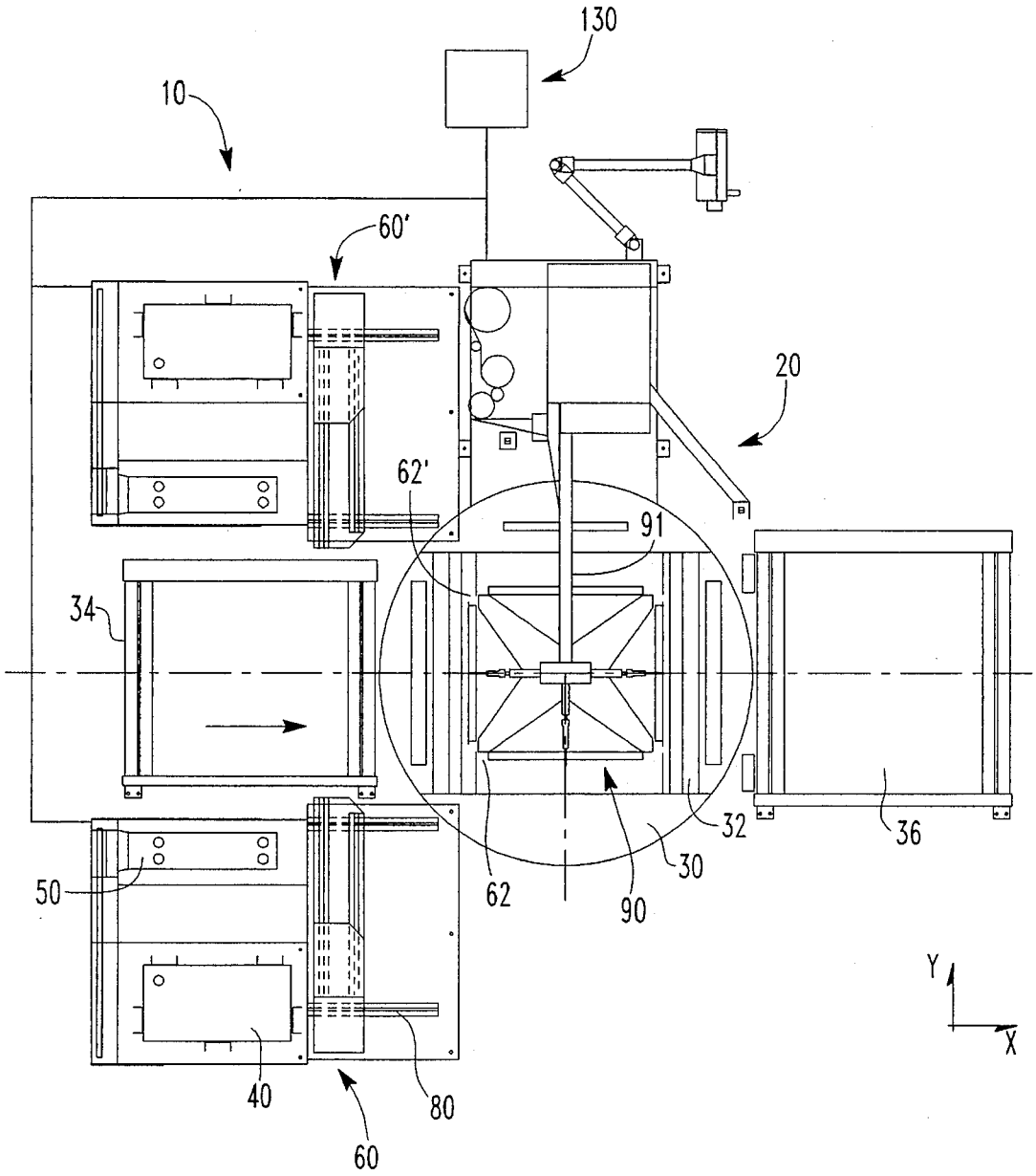
FIG. 1 is a schematic plan view of an embodiment of an apparatus incorporating the present invention, including a loading station, a picker, a corner board placer, a top platen, and a wrapping station.

Reference will now be made in detail to a present preferred embodiment of the invention, an example of which is illustrated in the accompanying drawings. Wherever possible, the same reference numbers will be used throughout the drawings to refer to the same or like parts.

The Apparatus

In accordance with the present invention, an apparatus is provided for the automated placement of corner boards on the corners of a load, and the wrapping of stretch wrap packaging material around the sides of the load with the corner boards held in place. To facilitate these functions, the apparatus of the present invention, designated generally by reference character 10, includes a wrapping station and a corner board placer.

The wrapping station 20 embodied herein includes a dispenser 22 for dispensing stretch wrap packaging material. The dispenser 22 preferably utilizes a roll carriage 23 to pre-stretch and dispense the packaging material. Wrapping is performed by providing relative rotation between the load 110 and the dispenser 22. In the preferred embodiment of the present invention, and as shown in FIG. 1, a turntable 30 is provided to rotate the load 110. However, a variety of other means may be used to provide this relative rotation, such as those shown in U.S. Pat. No. 5,161,349, which is incorporated herein by reference. Further, the roll carriage 23 may be adjusted vertically by a roll carriage lifting mechanism 25 as the load 110 is rotated by the turntable 30 to wrap the packaging material along the sides 111 of the load 110 in a spiral fashion. Additional features of the wrapping station 20 will be discussed in detail below.

To position the load 110 at the wrapping station 20, the load 110 may be manually stacked in place or positioned using a fork lift device. Alternatively, and as embodied herein, a conveyor system is provided to simplify and further automate operation. If a turntable is provided, as in the preferred embodiment of FIG. 1, the conveyor system preferably includes an infeed conveyor 34 for moving the load 110 onto the turntable 30, and an exit conveyor 36 for removing the load 110 after wrapping is complete. It is also preferred that the upper surface of the turntable 30 includes a series of rollers 32 driven in cooperation with the conveyor system to ensure proper positioning of the load 110.

In addition to wrapping a load with stretch wrap packaging material, it is advantageous to place corner boards on the corners of a load to secure and protect the load during shipping and storage. As noted above, and in accordance with the present invention, the apparatus embodied herein includes a corner board placer for placing a corner board on a corner of the load. Each corner board 120 that is placed on the load generally includes a first portion 121 and a second portion 122 connected along a fold line 124. The fold line 124 could be precreased, or merely could be the location where the fold is to occur in a uniform blank. Each of the first and second portions 121,122 includes an outer edge 125 opposite and generally parallel to the fold line 124. The length of the corner board 120 along the fold line 124 is preferably equal to the overall length of the corner 112 on which the corner board 120 is to be placed. For example, if the corner board 120 is to be placed on a vertical corner 112 of the load 110, the length of the corner board 120 should be about the height of the load 110.

The corner board 120 may be preformed substantially in an L shape so the first and second portions 121,122 are connected along the fold line 124 to form an angle corresponding to that of the corner 112 on which the corner board 120 is to be placed. Typically, the first and second portions 121,122 form a right angle. The preformed corner board 120 may be fabricated from a variety of durable materials, including polyvinyl, metal, wood, or corrugated paper. Alternatively, and as preferably embodied herein, the corner board 120 may be formed from a corner board blank 120' made of sheet material, such as corrugated paper or the like. To form the corner board 120, the corner board blank 120' is folded along the fold line 124 to form the corresponding angle between the first and second portions 121,122.

Figure 16A:
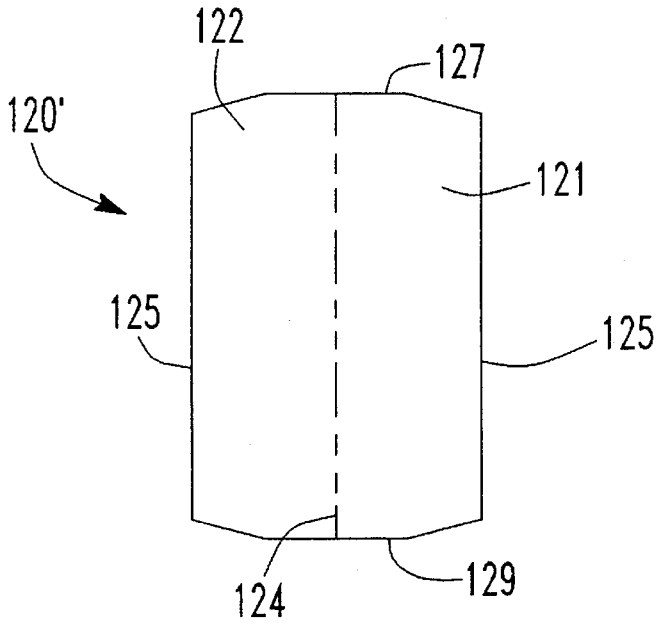
FIGS. 16A and 16B are views of exemplary embodiments of corner board blanks incorporating tapered top and bottom edges.
Figure 16B:
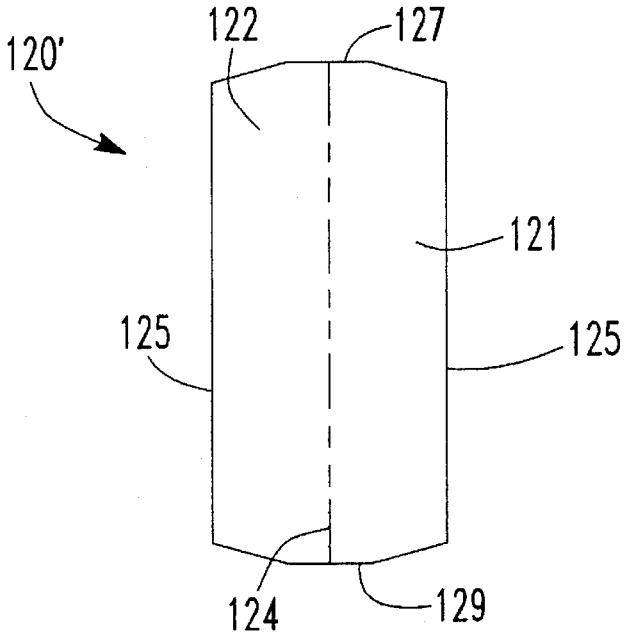

Additionally, in some applications, a top cap 114 and a bottom cap 116 may be placed on a load 110 for further protection during shipping and storage. Each of the top and bottom caps 114,116 include a central panel similar in size and shape to the respective top and bottom of the load 110, and outwardly extending tabs 115 that are folded against the respective sides of the load 110 after corner boards 120 have been placed on the corners of the load 110. When such top and bottom caps 114,116 are located on the load 110, one aspect of the present invention includes providing each of the first and second portions 121,122 of the corner board 120 with a tapered top edge 127 and a tapered bottom edge 129 generally transverse to the fold line 124 so the outer edges 125 are shorter than the fold line 124. Exemplary embodiments of corner board blanks 120' incorporating tapered top and bottom edges 127,129 are shown in FIGS. 16A and 16B. In this manner, the outer edges 125 likewise are shorter than the distance between the outwardly extending tabs 115 of the top cap 114 and the outwardly extending tabs 115 of the bottom cap 116. The outer edges 125 of the first and second portions 121,122 therefore are more readily insertable between the outwardly extending tabs 115 of the top and bottom caps 114,116, and the tapered top and bottom edges 127,129 of the first and second portions 121,122 effectively operate as camming surfaces to facilitate proper placement of the corner board 120 without inadvertent engagement with the tabs 115 of top and bottom caps 114,116.

The corner board placer of the present invention may be supplied with a corner board either manually or by automation for subsequent placement on the corner of a load. To further enhance automation, the apparatus embodied herein includes a loading station and a picker for supplying the corner board placer with a corner board. Generally, the loading station is configured to contain a plurality of corner boards or corner board blanks stacked in a horizontal orientation, and the picker is arranged to lift and convey the top corner board or corner board blank from the loading station to the corner board placer.

For purpose of illustration and not limitation, FIG. 2A shows one exemplary embodiment of a loading station 40, which includes a base plate 42 and a number of upstanding guide members 44 that define a magazine for containing a stack of corner board blanks 120' in a horizontal orientation. Due to this configuration, the number of corner board blanks 120' that are contained in the loading station 40 may be increased simply by using guide members 44 of greater height. Further, the guide members 44 are arranged so that each corner board blank 120' is maintained with its bottom edge 129 and fold line 124 in a predetermined location.

Preferably, the guide members 44 are adjustable to accommodate corner board blanks 120' of different dimensions. For example, slotted support blocks 46 are provided in the exemplary embodiment of the invention, and as best seen in FIG. 2B, to enable adjustment of the guide members 44. The slots 47 in the slotted support blocks 46 correspond to preset corner board blank 120' dimensions. In this manner, the guide members 44 along both sides of the loading station 40 are adjusted equally to accommodate a different corner board blank width while still maintaining the predetermined location of the fold line 124 of each corner board blank 120'. Similarly, the predetermined location of the bottom edge 129 of the corner board blanks 120' is maintained by only adjusting the guide members 44 corresponding to the top edge 127 of the corner board blanks 120' when accommodating a different corner board blank height. Although the exemplary embodiment of FIG. 2A depicts a loading station 40 configured to contain corner board blanks 120', the loading station 40 likewise may be adapted to contain preformed corner boards 120.

Figure 3:
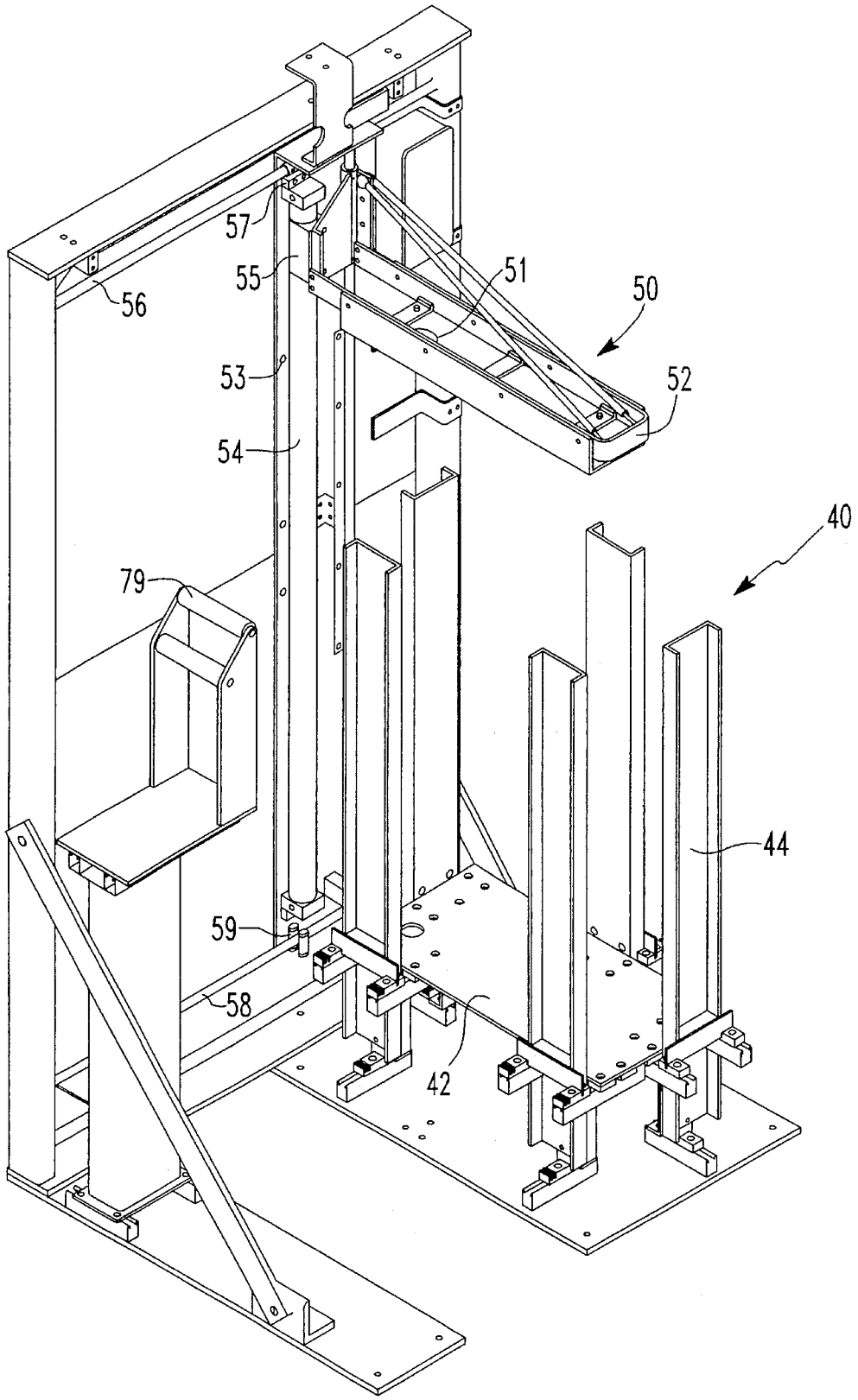
FIGS. 3 through 7 are sequential enlarged perspective views of the picker lifting and conveying a corner board blank from the loading station to the corner board placer shown in FIG. 1.
Figure 4:
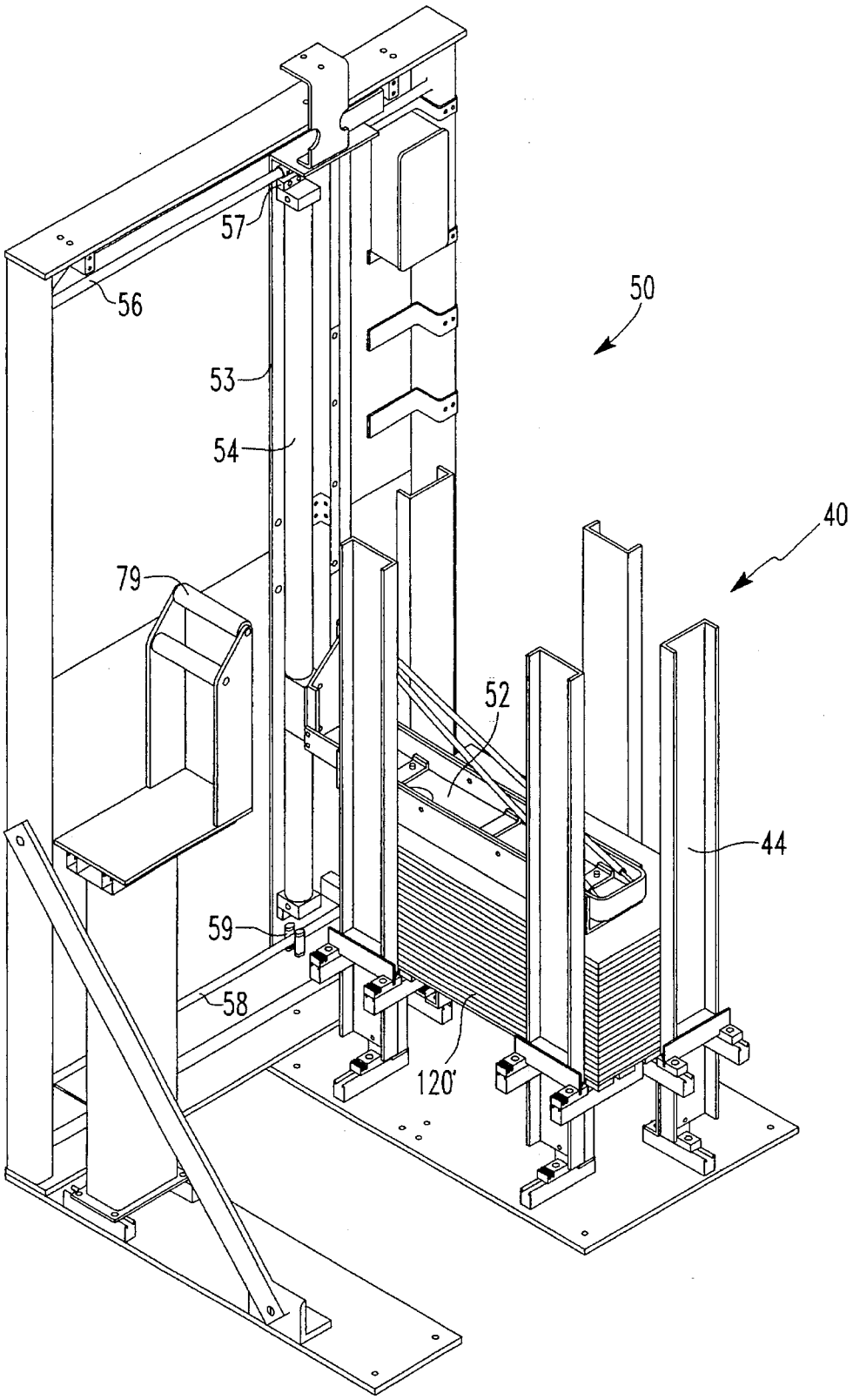

As previously noted, the apparatus of the present invention preferably includes a picker to lift and convey the top corner board blank from the loading station to the corner board placer FIG. 3 shows that the picker 50 embodied herein preferably includes a cantilevered carriage 52 that is moveable in both the vertical and horizontal direction. For movement in the vertical direction, the cantilevered carriage 52 is provided with low friction bushings 55 that cooperate with a vertically oriented polished shaft 54. The cantilevered carriage 52 preferably is driven along the vertical shaft 54 by a rodless pneumatic cylinder (not shown), although a similar hydraulic or mechanical drive mechanism may also be used. With the vertical shaft 54 operating as a raceway for the bushings 55, the rodless pneumatic cylinder is operated by a pneumatic solenoid valve to move the cantilevered carriage 52 vertically. The vertical shaft 54 and the pneumatic cylinder are mounted on a frame 53.

Movement of the cantilevered carriage 52 in the horizontal direction preferably is accomplished in a similar manner. The frame 53 on which the vertical shaft 54 and rodless pneumatic cylinder are mounted is provided with low friction bushings 57 that cooperate with an upper horizontal shaft 56, and rollers 59 that cooperate with a lower horizontal shaft 58. Again, a rodless pneumatic cylinder and a solenoid valve (not shown) are preferred for moving the frame 53, and thus the cantilevered carriage 52, along the horizontal shafts 56,58.

Although a variety of mechanisms may be used to engage and lift the top corner board blank 120' from the loading station 40, the picker 50 embodied herein utilizes a vacuum system. The underside of the cantilevered carriage 52 is provided with a picker vacuum seal device 51 for vacuum engagement with the top corner board blank 120' at the loading station 40. The picker vacuum system also includes a picker vacuum generator for drawing a vacuum through the picker vacuum seal device 51, and a picker vacuum sensor for detecting when a vacuum has been drawn in the picker vacuum system.

Figure 5:
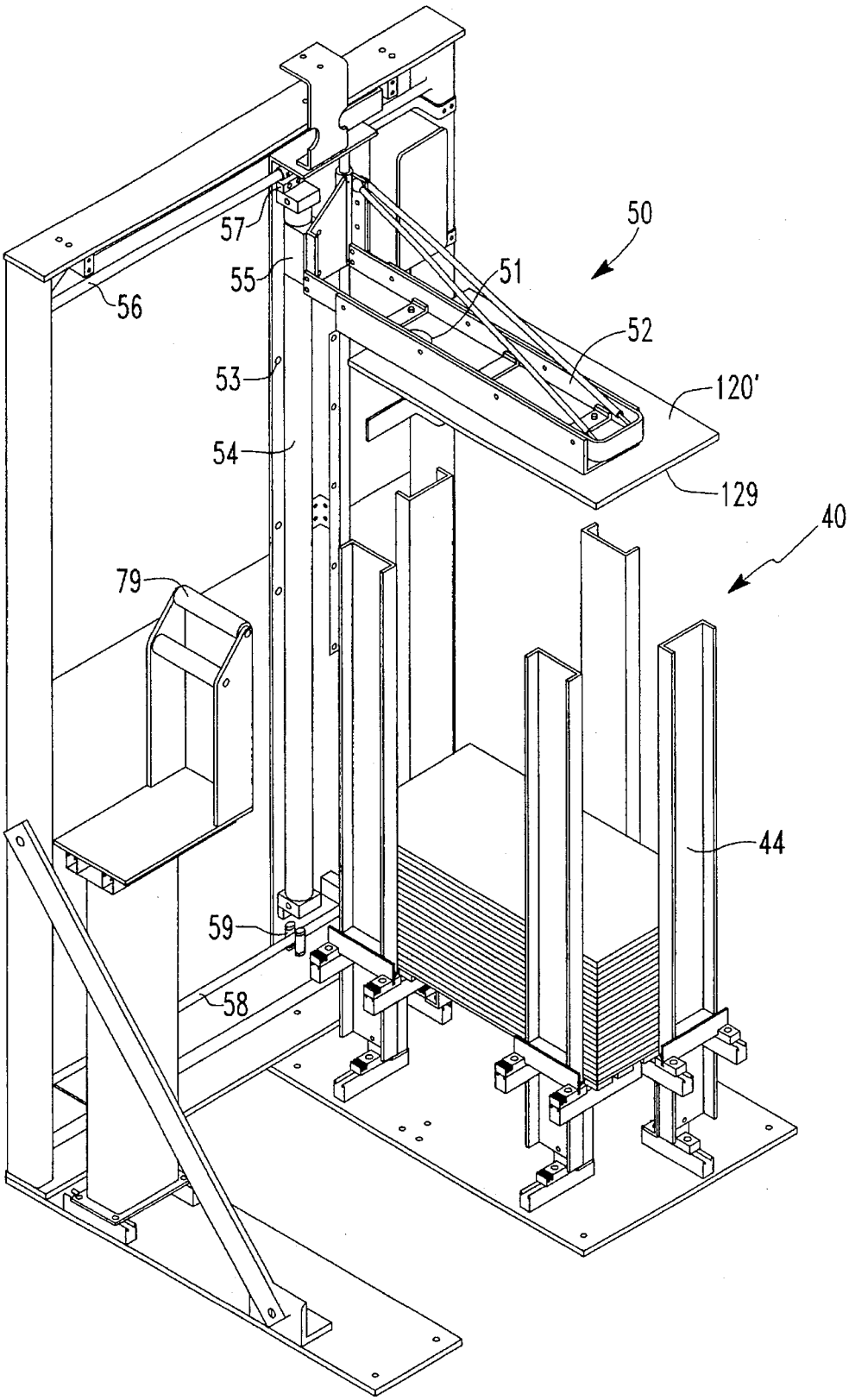
Figure 6:
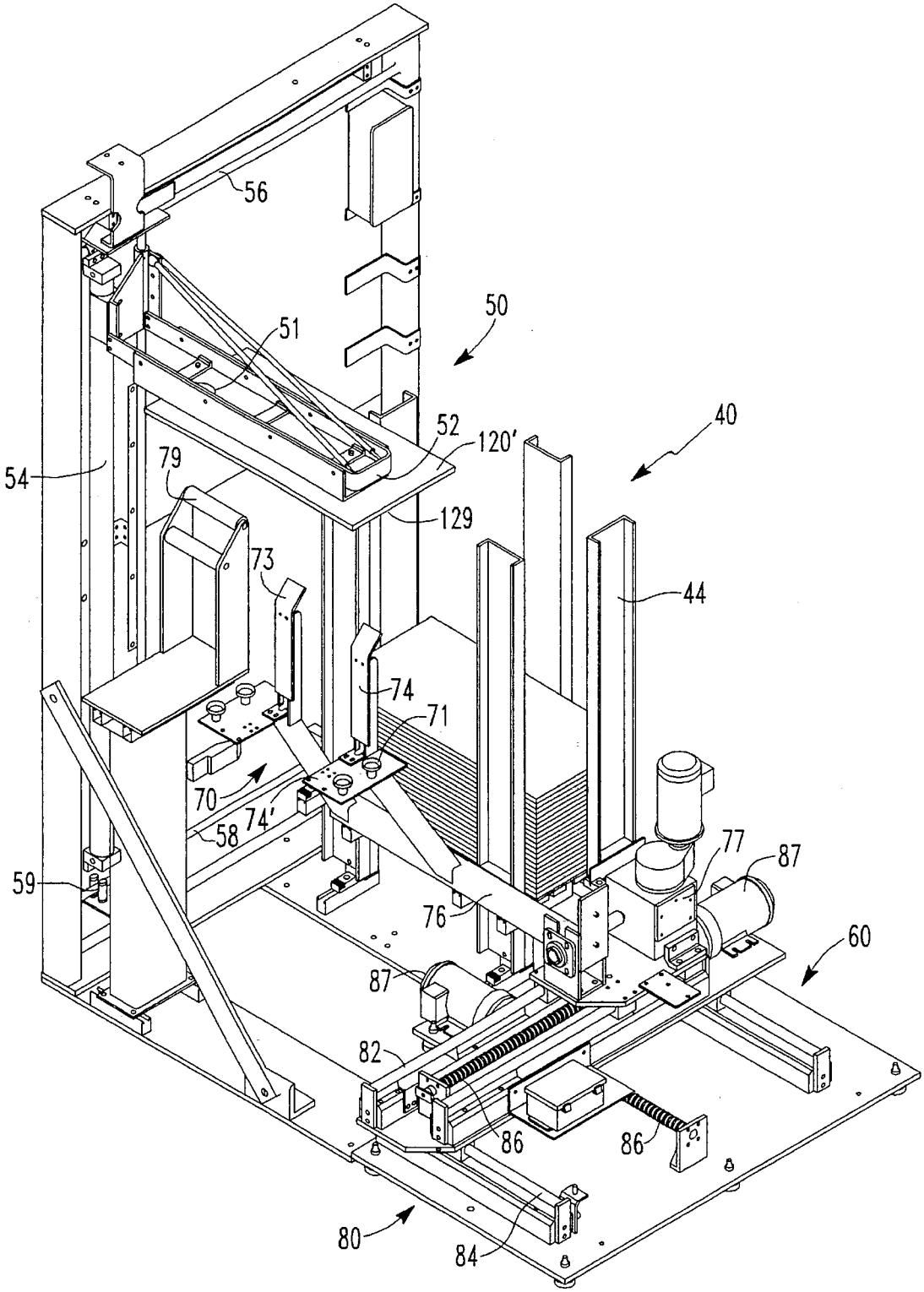

When a corner board blank 120' is engaged by the picker vacuum seal device 51, the corner board blank 120' cooperates with the picker vacuum seal device 51 to establish a vacuum in the picker vacuum system. This vacuum is detected by the picker vacuum sensor to indicate that a corner board blank 120' has been engaged. Once engaged, the corner board blank 120' is lifted vertically from the loading station 40 by vertical movement of the carriage 52 along the vertical shaft 54, as shown in FIG. 5, and moved horizontally along the horizontal shafts 56,58 to a position above the corner board placer, as shown in FIG. 6. The corner board blank 120' is then lowered vertically into the corner board placer by the corresponding movement of the carriage 52 along the vertical shaft 54. By controlling the location of the bottom edge 129 of the corner board blank 120' at the loading station 40, the corner board 120 is supplied to the corner board placer with the bottom edge 129 in a predetermined position to correspond with the bottom of the load 110.

Movement of the picker 50 and operation of the picker vacuum system is controlled by a programmable logic controller 130, such as Model SLC 5/03 manufactured by Allen-Bradley, which outputs signals to the solenoid valves that operate the rodless pneumatic cylinders based on inputs from the picker vacuum sensor. Other controllers employing electronic or electromechanical control systems may also be used. The preferred embodiment of the picker 50 may likewise be adapted to lift and convey preformed corner boards 120 from the loading station 40 to the corner board placer.

Figure 8:
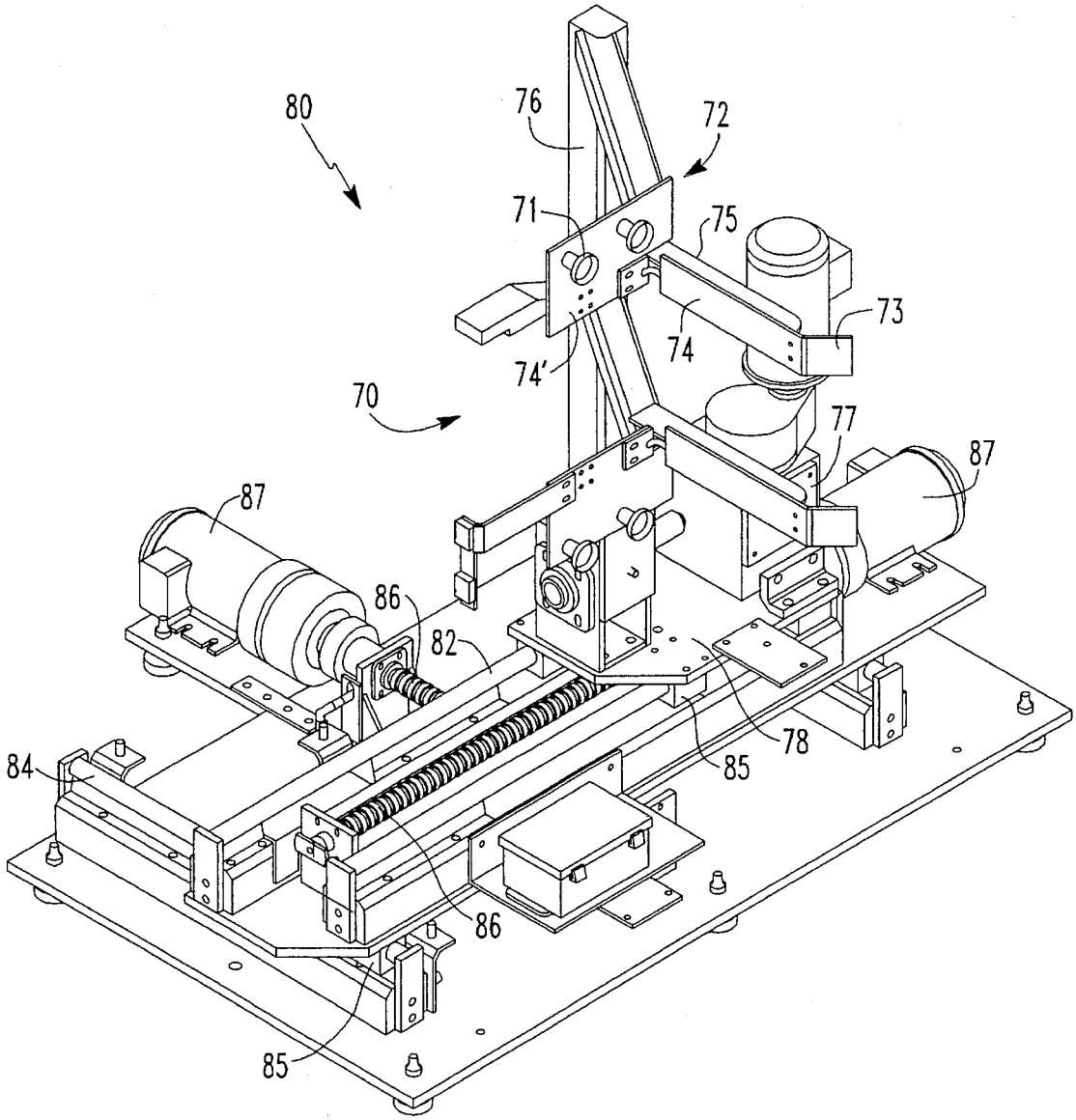
FIG. 8 is an enlarged perspective view of the placer shown in FIG. 1.

As seen in FIG. 8, the corner board placer 60 embodied herein generally includes a carrier and a placer mechanism. The carrier receives and retains the corner board that is supplied to the corner board placer. Various embodiments of carriers may be used, depending upon the type and configuration of the corner board that is to be placed on the corner of the load. Preferably, however, the carrier 70 includes at least one pair of finger members 72 meeting at an angle similar to that formed by the first and second portions 121,122 of the corner board 120. As seen in FIG. 8, the carrier 70 embodied herein includes two pairs of finger members 72.

For enhanced versatility, it is preferred that at least one finger member 74 of each pair 72 is pivotally mounted to provide means for adjusting the angle between the pair of fingers members 72. In this manner, the pivotally mounted finger member 74 of each pair 72 may be used to fold a corner board blank 120' into a corner board 120, or alter the angle between the first and second portions 121,122 of a corner board 120 to assist in placement of the corner board 120 on the corner 112 of a load 110 having top and bottom caps 114,116, as will be discussed. A conventional hinge or pin arrangement may be used to pivotally mount each pivotally mounted finger member 74, and a pneumatic cylinder 75 or similar drive system may be used to operate the pivotal movement of the pivotally mounted finger members 74.

Figure 7:
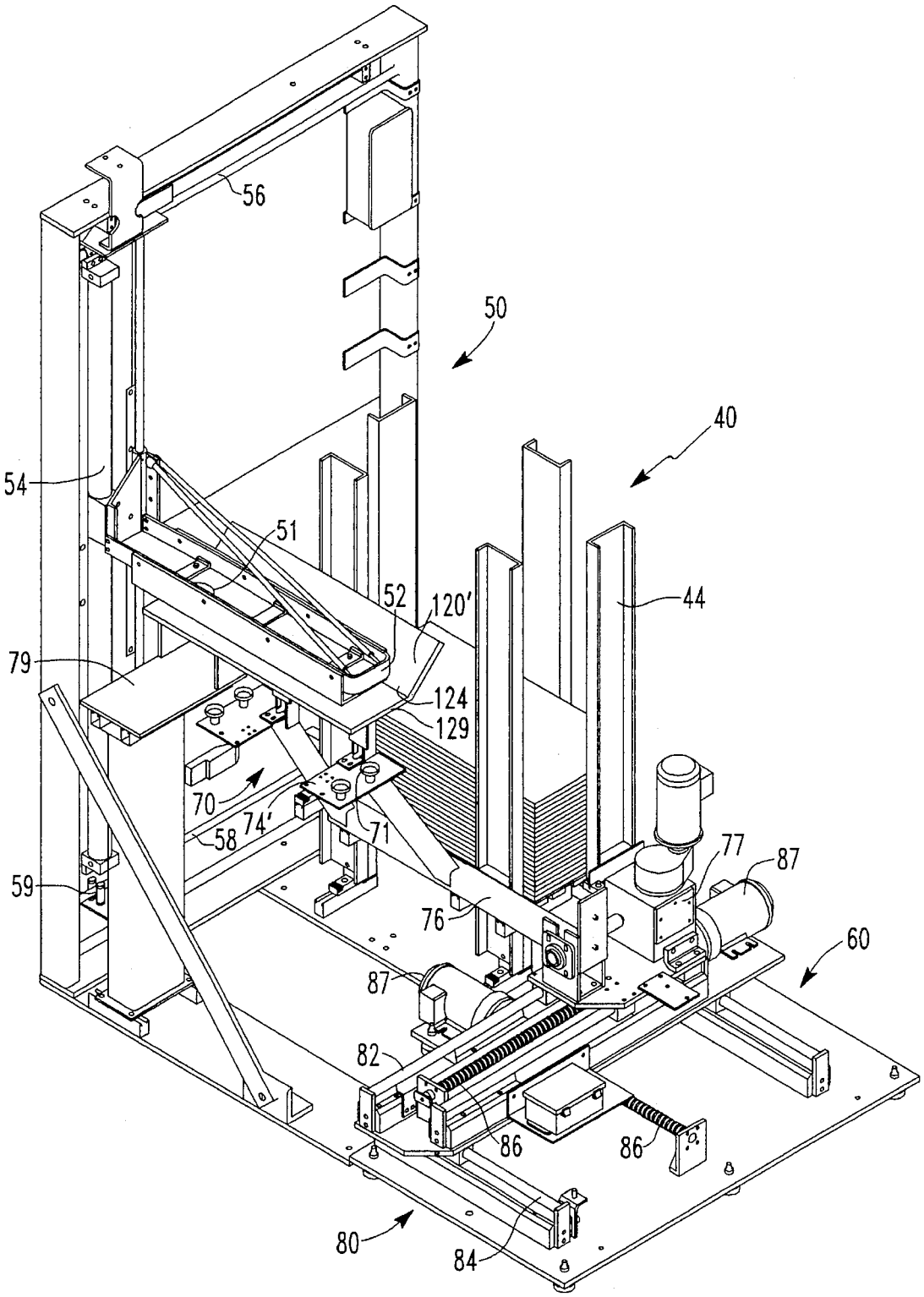

In the preferred embodiment of the invention, each pair of finger members 72 is arranged with one of the finger members extending horizontally and the other finger member extending vertically as a corner board 120 or corner board blank 120' is lowered into the carrier 70. For example, FIG. 7 shows the pivotally mounted finger members 74 extending vertically in the preferred embodiment. In this manner, the carrier 70 is arranged to receive a corner board 120 that is supplied in a horizontal orientation. However, the carrier 70 likewise may be arranged to receive a vertically oriented corner board 120 if an alternate loading procedure is used.

When a corner board blank 120' is used to supply the corner board placer 60 with a corner board 120, it is further preferred that each vertically extending finger member 74 has an angled free end 73. As seen in FIG. 7, the angled free ends 73 of the vertically extending finger members 74 operate as a camming surface that forces the corner board blank 120' to fold about its fold line 124, and thus form the corner board 120 for placement on a corner 112 of the load 110. A separate, stationary roller assembly 79 may also be provided to assist in folding the corner board blank 120' about its fold line 124. To facilitate this folding operation, the picker 50 is arranged to vacuum engage only one portion of the corner board blank 120', with the other portion remaining unobstructed for movement about the fold line 124 as the corner board blank 120' is lowered into the carrier 70. If preformed corner boards 120 are used, the angled free ends of the vertically extending finger members are not necessary and the folding operation does not occur.

Figure 9A:
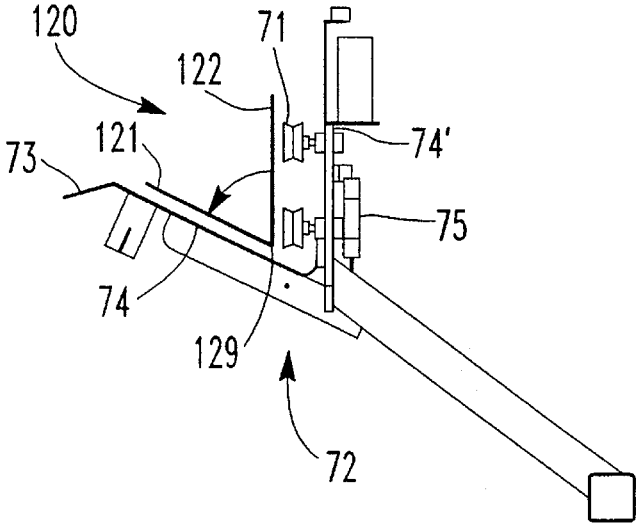
FIG. 9A is a fragmentary top view of the carrier of the corner board placer shown in FIG. 8.
Figure 9B:
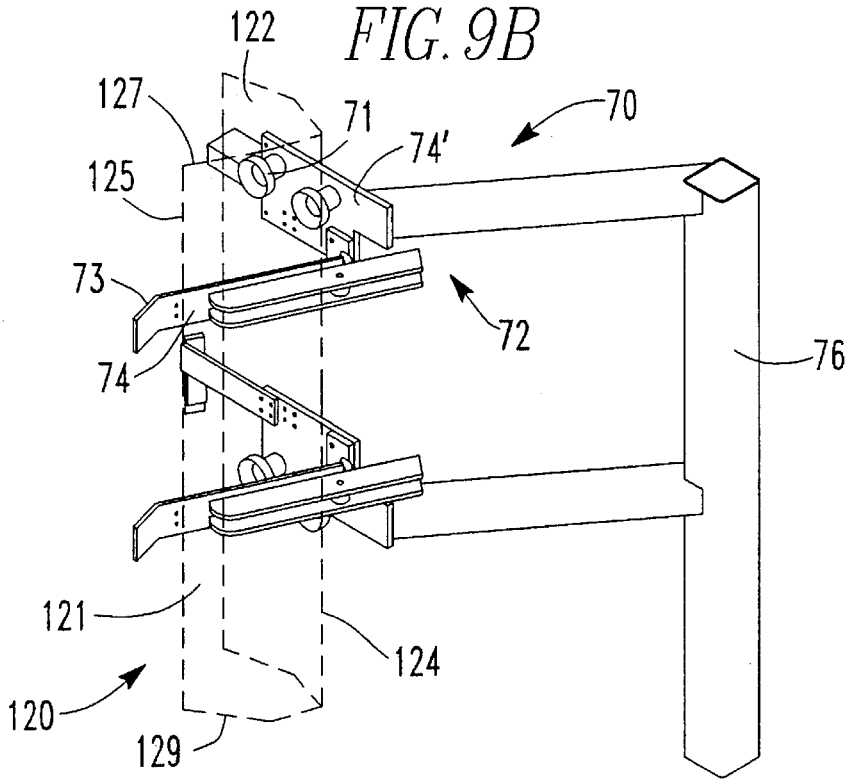
FIG. 9B is a fragmentary perspective view of the carrier of the corner board placer shown in FIG. 8.

Preferably, the carrier 70 further includes a carrier vacuum system to retain the corner board 120 within the pair of finger members 72 of the carrier 70. The carrier vacuum system includes a carrier vacuum seal device 71 mounted on at least one of the finger members, a carrier vacuum generator for drawing a vacuum through the carrier vacuum seal device 71, and a carrier vacuum sensor (not shown) for detecting when a vacuum has been drawn. FIGS. 9A and 9B show the carrier vacuum seal device 71 mounted on the stationary finger member 74' of each pair 72. Hence, when a corner board 120 is received by the carrier 70, the corner board 120 cooperates with the carrier vacuum seal device 71 to establish a vacuum in the carrier vacuum system. This vacuum is detected by the carrier vacuum sensor to indicate that a corner board 120 has been received. Once the vacuum in the carrier vacuum system is detected, the picker vacuum system is secured to eliminate the vacuum in the picker vacuum system and release the corner board 120 to the carrier 70. Operation of the carrier vacuum system is controlled by the controller 130. Rather than using a vacuum system, it is possible to provide the carrier 70 with mechanical grippers or the like to retain the corner board 120 in the carrier 70.

Although the present invention may be used to place corner boards 120 on either horizontal or vertical corners of a load 110, the exemplary embodiment presented herein is configured to place corner boards 120 on the vertical corners 112 of a load 110. Since the carrier 70 receives and retains horizontally oriented corner boards 120 the preferred embodiment of the apparatus further includes a pivotal arm structure 76 to raise the corner board 120 that is retained by the carrier 70 into a vertical orientation. That is, one end of the corner board 120 is raised relative to the other end by the pivotal movement of the pivoting arm structure 76. As seen in FIG. 8, the carrier 70 is fixed to one end of the pivotal arm structure 76. The opposite end of the pivotal arm structure 76 is pivotally mounted to a base 78. Pivoting of the pivotal arm structure 76 may be performed by a mechanical device 77, or by either a hydraulic or pneumatic device. If the corner board 120 is originally received in the vertical orientation, or if the corner board 120 is intended to be placed on a horizontal corner 112 of the load 110, then a pivoting arm structure 76 would not be required.

Once received by the carrier 70 and oriented vertically by the pivoting arm structure, the corner board 120 may then be placed on a corner 112 of the load 110. To simplify proper placement of the corner board 120 on a corner 112 of the load 110, the load 110 is positioned at the wrapping station 20 with one corner 112 generally oriented to receive the corner board 120 from the corner board placer 60. However, due to the configuration and operation of the apparatus of the present invention, the positioning of the load 110 and the orientation of the corner 112 need not be exact. This general location is referred to below as the corner board placement position 62, as seen in FIG. 1.

In addition to the carrier, the corner board placer of the present invention also includes a placement mechanism. The placement mechanism moves the carrier, and thus the corner board retained therein, in a controlled manner to ensure proper placement of the corner board on the corner of the load that is oriented at the corner board placement position. In particular, and in accordance with one aspect of the present invention, the placement mechanism of the corner board placer places the corner board on the corner of the load by moving the corner board toward the corner in a direction oblique to respective sides of the load that meet along the corner, while maintaining the first and second portions of the corner board generally parallel with these respective sides of the load. In this manner, the first and second portions of the corner board are simultaneously placed proximate the respective sides of the load.

To accomplish this oblique movement of the corner board, yet maintain the first and second portions of the corner board generally parallel with the respective sides of the load that meet at the corner, the placement mechanism preferably moves the carrier simultaneously and synchronously in directions orthogonal to these respective sides. This movement may be accomplished by a two-link robotic arm having the carrier rotatably mounted at its free end. Alternatively, it is possible that this movement may be accomplished by mounting the carrier on a remotely controlled wheeled base, an automated guide vehicle, an articulated arm with linkage, a trolley, or other such transport mechanisms.

In the preferred embodiment of the present invention, and as seen in FIG. 8, the placement mechanism utilizes a universal track drive assembly 80 to enable oblique movement of the corner board relative to the respective sides of the load. As previously mentioned, the carrier 70 is supported on a pivotal arm structure, which, in turn, is mounted on a base 78. The base 78 is mounted on the universal track drive assembly 80 for movement in a direction substantially orthogonal to one respective side 111 of the load 110 (the X direction), and in a direction substantially orthogonal to the other respective side 111 of the load 110 (the Y direction) when the corner 112 is oriented in the corner board placement position 62.

The universal track drive assembly 80 includes a first set of tracks 82 mounted orthogonal to and moveable along a second set of tracks 84. As seen in FIG. 8, the first set of tracks 82 is aligned in the Y direction, and the base 78 is mounted on the first set of tracks 82 by low friction bushings 85 for sliding movement in the Y direction. In the preferred embodiment of the apparatus 10, a threaded ball-screw 86 driven by an AC motor 87 is used to slide the base 78 along the first set of tracks 82. In turn, the second set of tracks 84 is aligned in the X direction, and the first set of tracks 82 is mounted on the second set of tracks 84 by low friction bushings 85 for sliding movement in the X direction. Similarly, a threaded ball-screw 86 and AC motor 87 preferably are used to slide the first set of tracks 82, and thus the base 78 and carrier 70, along the second set of tracks 84. However, alternative mechanisms may be used for movement along each set of tracks, such as a belt or chain drive operated by a DC or servo motor. In this manner, the carrier 70 effectively may be moved in the Y direction along the first set of tracks 82, in X direction along the second set of tracks 84, or obliquely by simultaneous and synchronous movement in both the X and Y directions.

The carrier 70 is further mounted on the base 78 so the corner board 120 generally faces the corner 112 of the load 110 that is oriented at the corner board placement position 62 when the corner board 120 is raised to the vertical orientation. Specifically, when the corner board 120 is raised, one of the first and second portions 121,122 of the corner board 120 is generally parallel with one of the respective sides 111 of the load 110 that meet at the corner 112, and the other of the first and second portions 121,122 is generally parallel with the other of the respective sides 111.

Figure 11A:
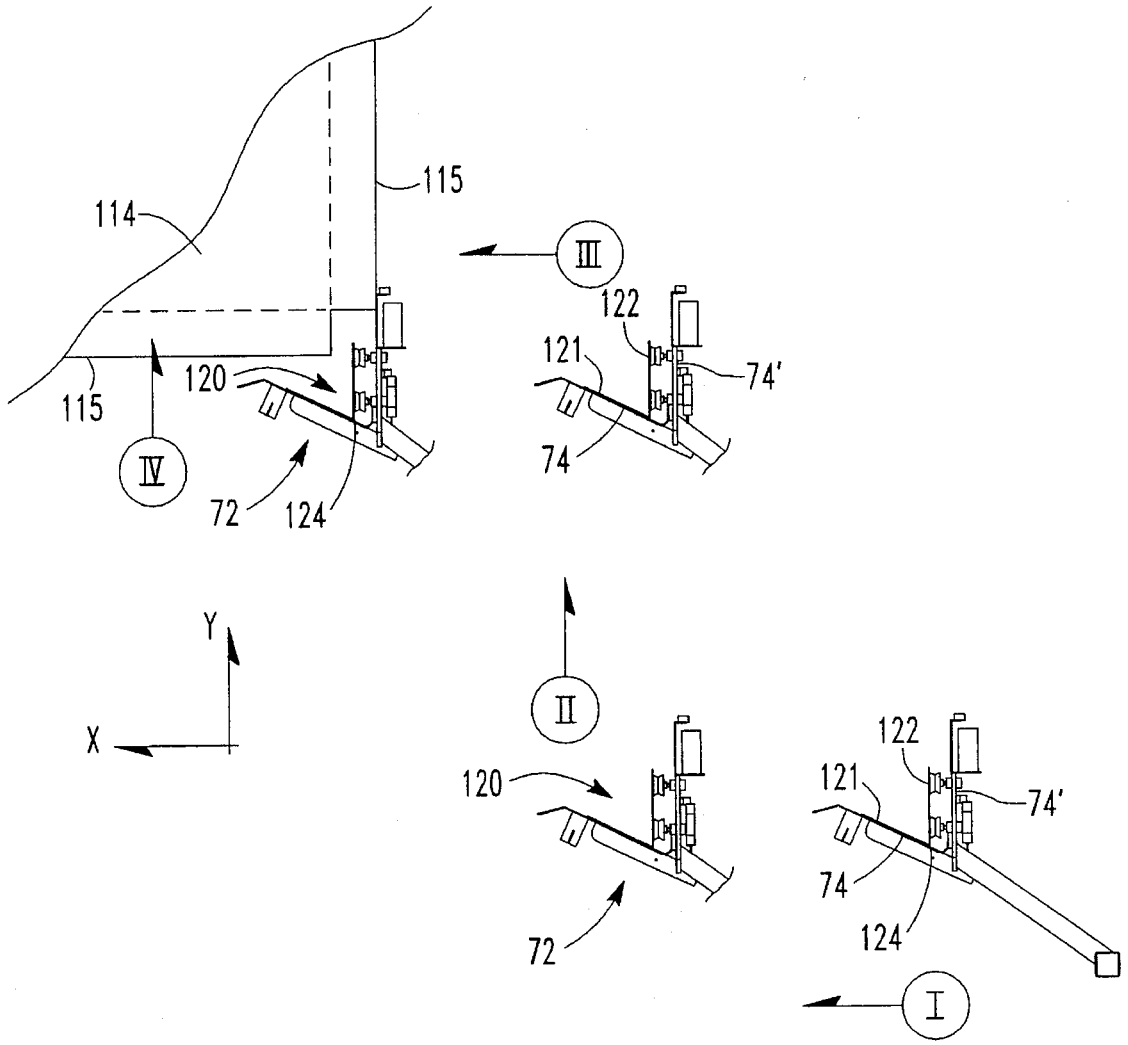
FIGS. 11A through 11D are sequential top views of the placement of a corner board on the corner of a load in accordance with the method of the present invention.
Figure 11B:
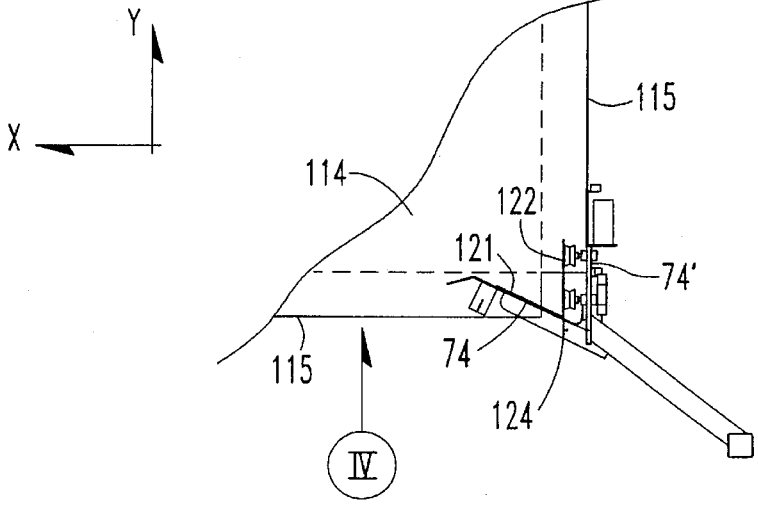
Figure 11C:
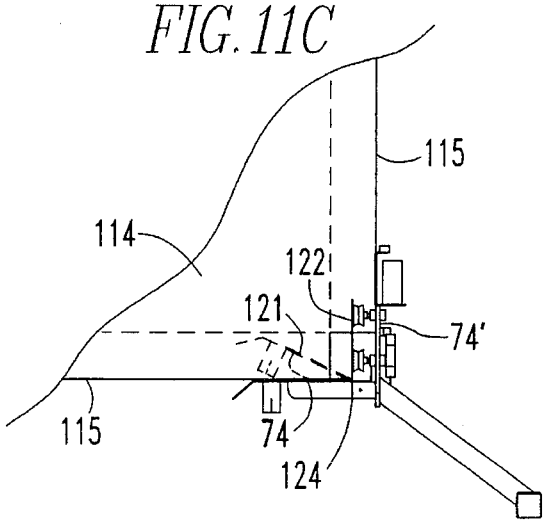

To move the corner board 120 into a position from which the corner board 120 is placed on the corner 112 of the load 110, the corner board 120 is then carried to the corner board placement position 62 to align the fold line 124 parallel with the corner 112 of the load 110 and the first and second portions 121,122 spaced from and generally parallel with the respective sides 111 of the load 110, as shown in FIG. 11C.

Figure 11D:
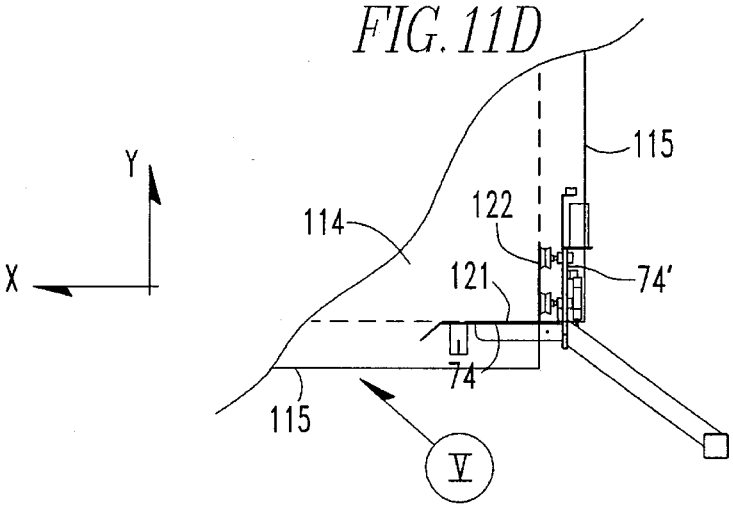
Figure 12:
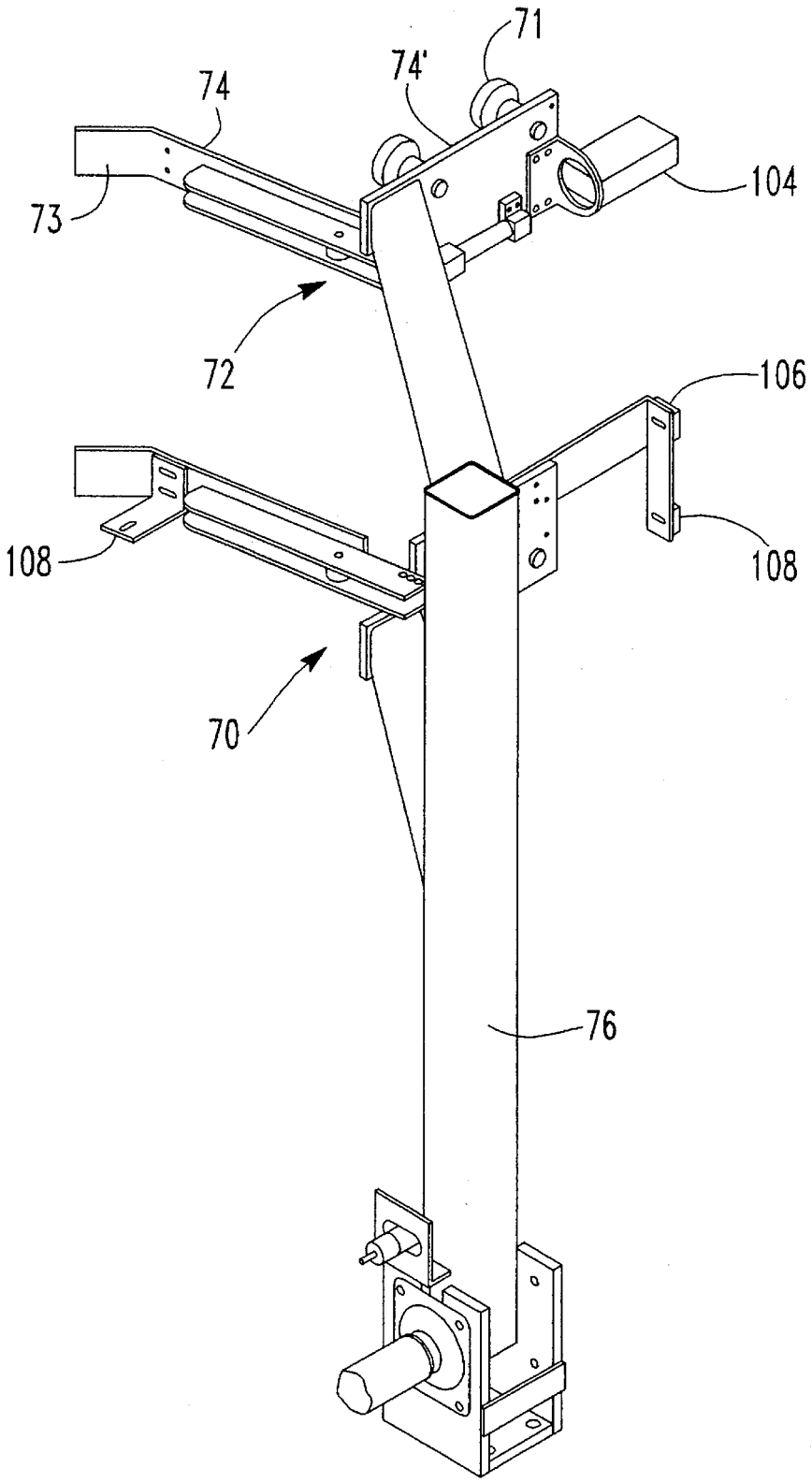
FIG. 12 is a perspective view of the sensor locations on the placer shown in FIG. 8.

Preferably, the corner board 120 is aligned with the corner 112 and moved into a position from which it is placed on the load through controlled movement along the first and second sets of tracks in the Y and X directions, respectively. The preferred sequence of controlled movement is presented in FIGS. 11A through 11D. This sequence of movements is controlled by the controller 130, preferably in combination with an optical sensor system. The preferred optical sensor system includes a series of sensors, such as photocells, mounted on the carrier 70, as shown in FIG. 12. However, alternative devices for detecting the movement of the corner board likewise may be used.

In accordance with the preferred sequence of movements, the corner board 120 is first moved a preset distance in the X direction to a mid-position, as depicted by arrow i in FIG. 11A, such as by turning the ball-screw 86 for the second set of tracks 84 a predetermined number of rotations. The corner board is then moved in the Y direction until the approaching-load sensor 104 indicates that the corner board 120 has approached the load, as depicted by arrow ii in FIG. 11A. When the approaching load sensor detects the load, a signal is output to the controller 130 to stop movement in the Y direction. As depicted by arrow iii in FIG. 11A, the corner board 120 then moves in the X direction until an intermediate-position sensor 106, preferably having a wide angle diffusion function with a precise detection range, detects that the corner board 120 reaches a specified distance from the load 110. During each movement of this preferred sequence, the controller 130 outputs a drive signal to the corresponding AC motors 87 of the first and second sets of tracks 82,84 to control the movement of the corner board 120, until the corresponding sensor outputs a signal that the desired position has been reached.

If top and bottom caps 114,116 are not provided on the load 110, then the corner board 120 is maintained with the first and second portions 121,122 generally at right angles to each other. Hence, the next preferred sequential movement of the corner board 120 is in the Y direction, as depicted by arrow iv in FIGS. 11A and 11B, until the at-load sensor 108, which is adjusted to short range detection, detects that the corner board is in a position where the first and second portions 121,122 are spaced from and generally parallel with the respective sides 111 of the load 110, as generally shown in FIG. 11C. The controller 130 then simultaneously and synchronously outputs corresponding variable frequency drive signals to the AC motors 87 of both the first and second tracks 82,84 to move the corner board obliquely toward the load, as seen in FIG. 11D, until the at-load sensors detect that the first and second portions 121,122 are positioned on or proximate to the respective sides 111.

As previously noted, when top and bottom caps 114,116 are provided on the load 110, the corner board 120 supplied for use in combination with the top and bottom caps 114,116 has a tapered top edge 127 and a tapered bottom edge 129 on each of the first and second portions 121,122. To place the tapered corner board 120 on the load 110 between the top and bottom caps 114,116, and in accordance with a different aspect of the invention, the corner board placer 60 forms an acute angle between the first portion 121 and the second portion 122 so the outer edges 125 of the first and second portions 121,122 may be inserted between the top and bottom caps 114,116 more readily. Specifically, the pivotally mounted finger members 74 of the carrier 70 are pivoted toward the stationary finger members 74' to form an acute angle between the first and second portions 121,122 of a corner board 120. An acute angle between about 60° to 70° is preferred. Pivoting of the pivotally mounted finger members 74 to form the acute angle between the first and second portions 121,122 is controlled by the controller 130.

Figure 10C:
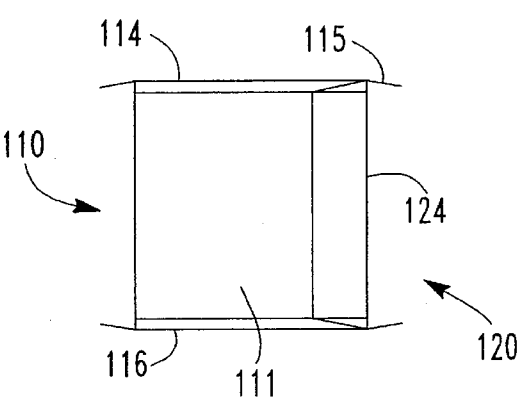
FIGS. 10A through 10C are sequential schematic side views of a corner board being inserted between top and bottom caps in accordance with the method of the present invention.
Figure 10B:
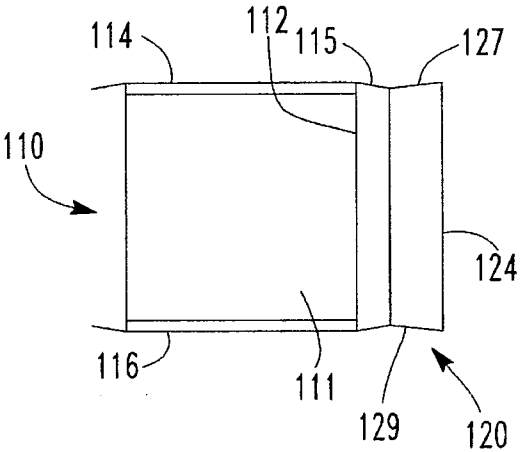
Figure 10A:
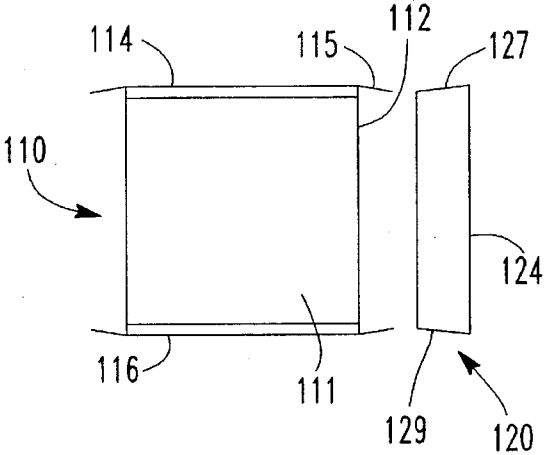

This angular relationship between the first and second portions 121,122 enables the tapered top and bottom edges 127,129 to operate more effectively as camming surfaces against the outwardly extending tabs 115 of the top and bottom caps 114,116. Hence, the controller 130, in combination with the optical sensor system, controls the operation of the placement mechanism to move the corner board 120 toward the corner 112 until the first and second portions 121,122 have been inserted between the top and bottom caps 114,116 so that the tapered top edges 127 of the first and second portions 121,122 are located directly below the outwardly extending tabs 115 of the top cap 114 and the tapered bottom edges 129 of the first and second portions 121,122 are located directly above the outwardly extending tabs 115 of the bottom cap 116, as seen in FIG. 11D. Preferably, the corner board 120 is inserted between the tabs 115 of the top and bottom caps 114,116 using a similar sequence of movements as that described above. However, due to the angular relationship between the first and second portions 121,122, the movement of the corner board 120 is stopped when the at-load sensor detects the position of either contact or proximity such as that shown in FIG. 11D. FIGS. 10 through 10C are sequential schematic side views of the corner board being inserted between the top and bottom caps in accordance with this aspect of the present invention.

Once inserted, the controller 130 then outputs a signal to the solenoid valve that operates the pneumatic cylinders 75 to pivot the pivotally mounted finger members 74 of the carrier 70 and open the corner board 120 to substantially form a right angle between the first and second portions 121,122, as seen in FIG. 11C. In this embodiment, the position shown in FIG. 11C is the position from which the corner board is placed on the load. In this position, the fold line 124 is aligned parallel with the corner 112 of the load 110 and the first and second portions 121,122 are spaced from and generally parallel with the respective sides 111 of the load 110 when the corner board 120 is opened to form the right angle. The corner board 120 is then placed on the corner 112.

Although not required according to the aspect of the invention just described, it is preferred, and in accordance with another aspect of the invention, that placement occur by moving the corner board 120 toward the corner 112 in a direction oblique to the respective sides 111 of the load 110 while maintaining the first and second portions 121,122 generally parallel with the respective sides 111 of the load 110 to simultaneously place the first and second portions 121,122 proximate the respective sides 111 of the load 110, as depicted by arrow v in FIG. 11D. To move the corner board 112 in the oblique direction, the controller 130 preferably outputs signals to the AC motors to simultaneously and synchronously drive the ball-screws 86 of the first and second sets of tracks 82,84. This orientation and placement of the corner board 120 prevents the load 110 from being damaged when the corner board 120 is being placed proximate to the load 110 by preventing outer edges 125 directly impacting the load 110.

In accordance with another aspect of the present invention, the apparatus also includes a restrainer for holding the corner board in place once the corner board has been placed on the corner with the first and second portions proximate respective sides of the load. By providing a restrainer to hold the corner board in place, the corner board placer can then release the corner board for subsequent corner board placement operation, as will be discussed.

Figure 13A:
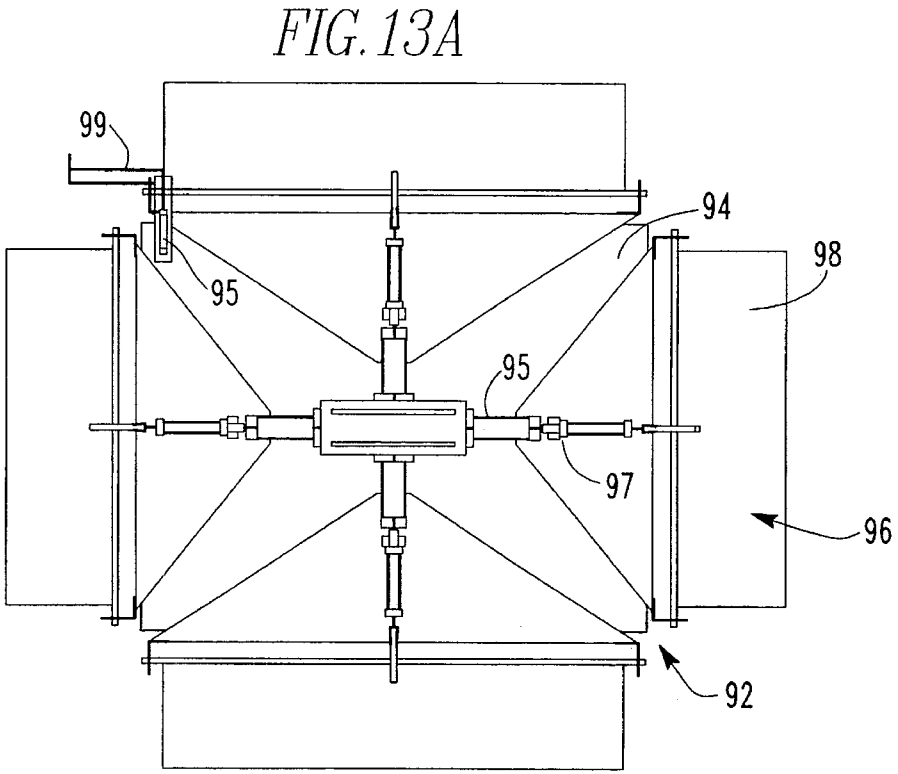
FIG. 13A is an enlarged top view of the top platen shown in FIG. 1.
Figure 13B:
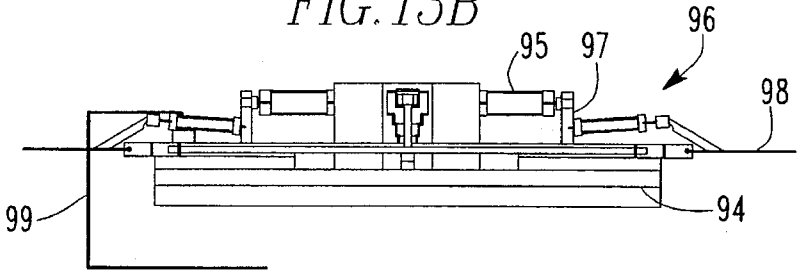
FIG. 13B is a front view of the top platen shown in FIG. 13A.
Figure 13C:
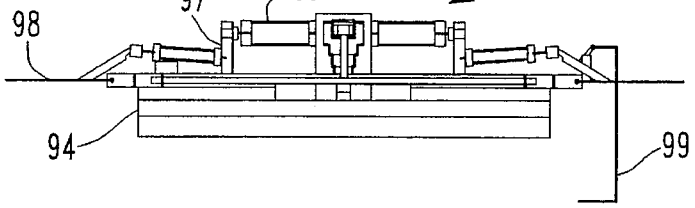
FIG. 13C is a side view of the top platen shown in FIG. 13A.
Figure 14:
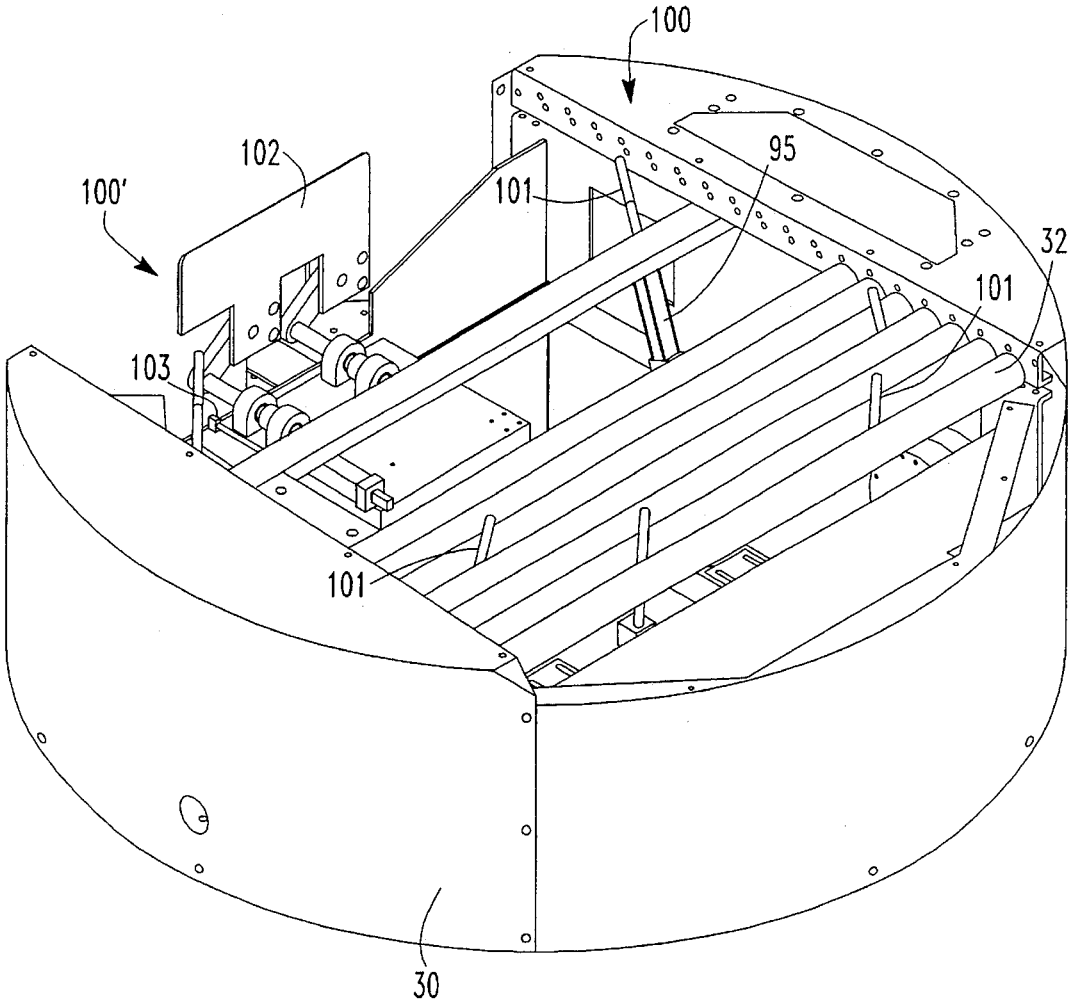
FIG. 14 is an enlarged fragmentary view of the turntable shown in FIG. 1.
Figure 15:
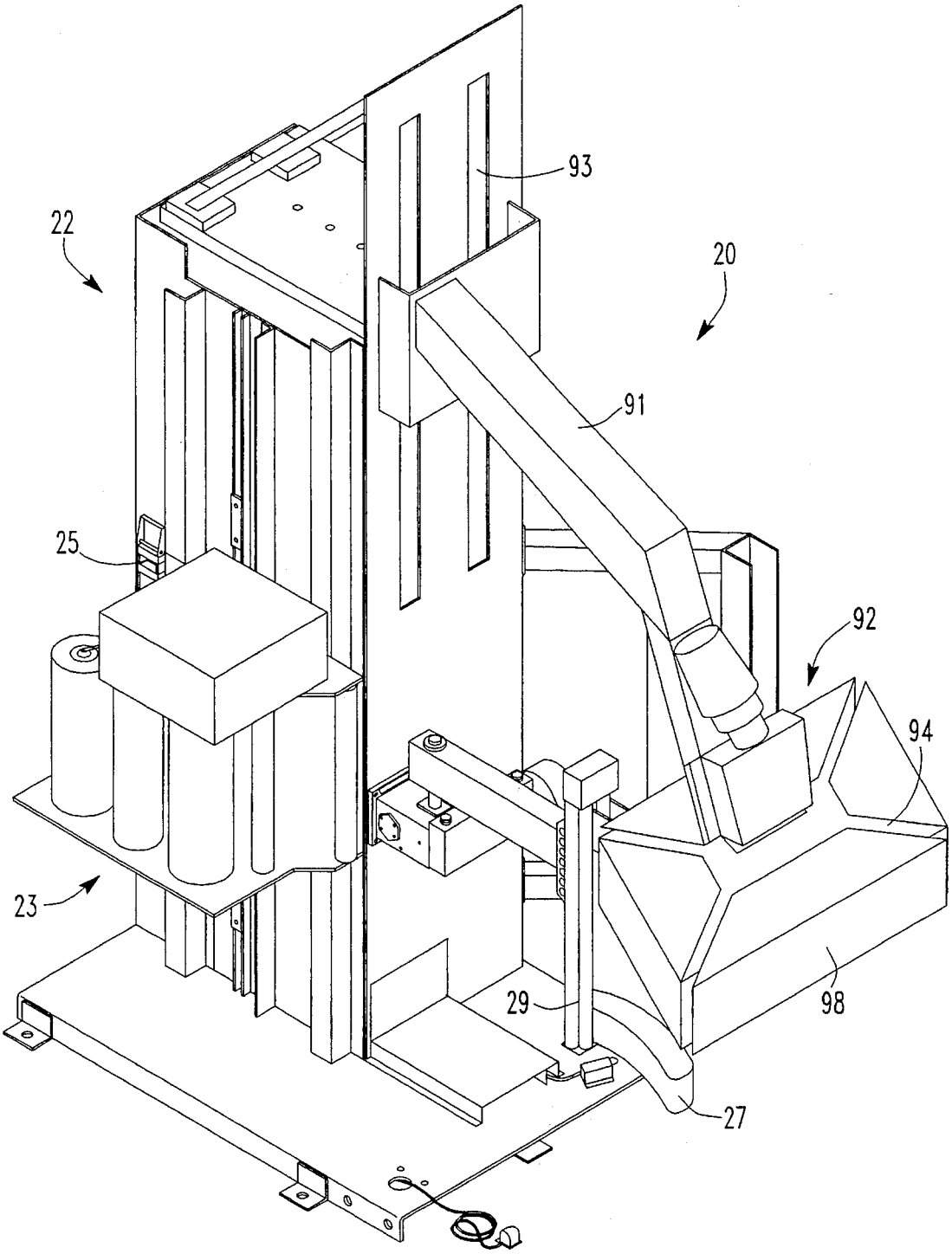
FIG. 15 is an enlarged perspective view of the wrapping station shown in FIG. 1.

As seen in FIGS. 13A through 13C, the restrainer 90 embodied herein includes a top platen 92 that is designed to rest on top of and rotate with the load 110 that is positioned on the turntable 30. The top platen 92 includes a pad 94, and a top restraining device 96 for each side 111 of the load 110. The pad 94 is rotatably connected to a cantilevered frame 91 at the loading station 40, which is vertically adjustable along a vertical track 93 by a chain drive and electric motor to accommodate loads of various heights. The controller 130 controls the vertical movement of the top platen 92 using signals outputted from limit switches located along the vertical track 93 and a proximity switch located on the cantilevered frame 91 to detect when the weight of the platen is placed on the load 110.

As seen in FIGS. 13A through 13C, each top restraining device 96 preferably is a pivoting plate 98 mounted on a slide mechanism 97. Although only one pivoting plate 98 is shown on each side 111 of the load 110, the apparatus may be provided with two separate pivoting plates 98 on each side of the load to separately hold the corner board 120 on each corner 112 of the respective side 111, particularly when only one corner board placer 60 is provided. The top restraining device 96 is operated by first pivoting the pivoting plate 98 down toward the respective side of the load 110, and then using a pneumatic cylinder 95 to draw the pivoting plate 98 along the slide mechanism 97 toward the respective side 111 of the load 110 until the corner board 120 is held in place.

Additionally, if top caps 114 are provided, the top restraining device may be used to fold the outwardly extending tabs 115 toward the load 110. When the pivoting plate 98 is first pivoted down, the corresponding tab 115 of the top cap 114 is partially fold toward the load 110. Likewise, when the pneumatic cylinder 95 draws the pivoting plate 98 along the slide mechanism 97 toward the respective side 111 of the load 110, the corresponding tab 115 is folded into a vertical orientation substantially against the respective side 111 of the load 110. This preferred embodiment of the top restraining device 96 is capable of accommodating top caps 114 of various sizes, and allows eccentric positioning of a load 110 relative to the top platen 92 without affecting the tab folding operation.

As further seen in FIGS. 13A through 13C, it is preferred that an extendable arm 99 also be provided on the top platen 92. Generally, the extendable arm 99 is used when two corner board placers 60 are provided. When a pivoting plate 98 is lowered to simultaneously restrain two corner boards 120 in place, a portion of each of the corner boards 120 remains unrestrained until the adjacent pivoting plate 98 is lowered. Therefore the extendable arm 99 is preferred to prevent the unrestrained portion of the corner board 120 that is directed toward the dispenser 22, as seen in FIG. 1, from inadvertently engaging the stretch wrap packaging material. One end of the L shaped extendable arm 99 is pivotally mounted to the pad 94, wherein pivotal motion is provided by a pneumatic cylinder 95 or similar mechanism that is controlled by the controller 130. When the extendable arm 99 is pivoted to a lowered position, the horizontal extension of the L shaped arm engages and holds the unrestrained portion of the corner board 120 in place until the corresponding pivoting plate 98 of the respective side 111 is lowered.

To restrain the bottom edge 129 of each corner board 120 after it has been placed on a corner 112 of the lead 110, the restrainer 90 embodied herein also includes bottom restraining devices 100. The preferred embodiment of these bottom restraining devices are extendable rods 101 located between the rollers 32 in the turntable 30. The extendable rods 101 that are located generally along the ends of the rollers 32 are angled toward the center of the lead 110, so loads 110 of various widths may be accommodated. Further, a seek-and-find bottom restraining device 100' can be provided to accommodate loads 110 of various lengths. The seek-and-find restraining device 100' includes an extendable plate 102 mounted on a slide mechanism 103, such that the extendable plate 102 is raised and then drawn along the slide mechanism 103 toward the respective side 111 of the load 110 to hold the corresponding corner boards 120 in place. Preferably, a pneumatic cylinder 95 continues to draw the extendable plate 102 toward the load until engagement with the corresponding side 111 of the load 110 occurs, although other methods may be used.

The bottom restraining devices 100 are preferably operated by pneumatic cylinders 95 activated by solenoid valves, and are controlled by the controller 130 for synchronous operation with the top restraining devices 96. As with the top restraining devices 96, the bottom restraining devices 100 may be used to fold the outwardly extending tabs 115 of the bottom caps 116. As noted above, if only one corner board placer 60 is provided, it is preferred that two separate top and bottom restraining devices be provided for each side 111 of the load 110. If two corner board placers 60 are provided, then only one top restraining device 96 and one bottom restraining device 100 are required for each side 111. In this manner, the controller 130 delays operation of the top and bottom restraining devices 96,100 corresponding to a respective side 111 of the load 110 until a corner board 120 has been placed on either corner 112 of the respective side 111.

Once the top and bottom restraining devices 96,100 have been activated to hold the corresponding corner board 120 in place, and in accordance with this aspect of the invention, the corner board placer 60 then releases the corner board 120 for subsequent corner board placement operation. This is preferably accomplished by securing the carrier vacuum generator to eliminate the vacuum in the carrier vacuum system, as controlled by the controller 130. The corner board placer 60 is then moved away from the corner board placement position 62 and the turntable 30 is rotated until a second corner 112 of the load 110 is oriented in the corner board placement position 62. The corner board placement operation is repeated by supplying the corner board placer 60 with a second corner board 120, aligning the second corner board 120 with the second corner 112, and placing the second corner board 120 on the second corner 112 in the manner described above.

By providing the apparatus with the restrainer 90, and in accordance with the present invention, corner board placement by the corner board placer 60 can be repeated sequentially until a respective corner board 120 is placed and held on each corner 112 of the load 110. Hence, only one corner board placer 60 is required to place a corner board 120 on each and every corner 112 of the load 110 prior to stretch wrapping operations. Preferably, however, two corner board placers are utilized to expedite corner board placement and stretch wrapping of the load 110. Although FIG. 1 shows one corner board placer 60 located on either side of the infeed conveyor 34, the corner places 60 may be located relative to any two corners of the load. In this manner, a third corner board 120 can be placed on a third corner 112 of the load 110 by the second corner board placer 60' at a second corner board placement position 62' while the first corner board 120 is placed on the first corner 112, and a fourth corner board 120 can be placed on a fourth corner 112 of the load 110 while the second corner board 120 is place on the second corner 112.

Once a respective corner board 120 has been placed on each corner 112 of the load 110, the controller 130 directs the turntable 30 to rotate, thereby wrapping the stretch wrap packaging material around the load 110. The roll carriage 23 of the dispenser 22 pre-stretches and dispenses the packaging material, preferably at a constant tension as the turntable 30 is rotated. The roll carriage 23 is adjusted vertically by the roll carriage lifting mechanism 25 as the load 110 is rotated by the turntable 30 to wrap the packaging material along the sides 111 of the load 110 in a spiral fashion until the roll carriage 23 reaches the top of the load 110. Rotation of the turntable 30 is continued until the desired number of top wraps have been applied, and then the roll carriage 23 is lowered to the bottom of the load 110 to apply the desired number of bottom wraps. Once wrapping is completed, rotation of the turntable 30 is stopped, a wiper arm 27 extends from the wrapping station 20 to wipe the packaging material against the load 110, and a cutter 29 is activated to cut the film. The tab folding devices and extendable arm 99 of the restrainer 90 are then retracted, and the top platen 92 is raised to allow the load 110 to exit.

While the restrainer is preferably a separate mechanical element, it also may include other arrangements for holding the corner board in place after it has been placed on the load, such as a mounting arrangement for the stretch wrap dispenser and the corner board places which allows the stretch wrap itself to hold each corner board in place after it has been placed on the load.

It is noted that as recited in the claims, the various aspects of the present invention may be used in combination, or independently, without departing from the scope of the invention. For example, in one embodiment of the present invention, an apparatus may include the restrainer 90 to allow sequential placement of corner boards 120 on the corners 112 of the load 110, yet the controller 130 may not control the corner board placer 60 to simultaneously place each corner board 120 on a respective corner 120 by movement in an oblique direction relative the respective sides 111 of the load 110 to simultaneously place the first and second portions 121,122 proximate the respective sides 111 of the load 110. Alternatively, another embodiment of the invention may include an apparatus having four corner placers to place each corner board by movement in an oblique direction, yet not include a turntable 30 or restrainer 90. Further, all combinations of the aspects set forth above may be incorporated in yet another embodiment of the invention.

The Method

The present invention is also directed to a method for stretch wrapping a load having sides and corners with stretch wrap material. In particular, and in accordance with the present invention, the method is directed to placing corner boards on the corners of the load, and wrapping stretch wrap packaging material around the load with the corner boards in place. To perform the method of the present invention, reference is generally made to the apparatus described in detail above.

The method embodied herein is typically initiated by positioning the load at a wrapping station having a dispenser for dispensing stretch wrap packaging material. As noted above, wrapping is performed by providing relative rotation between the load and the dispenser. In the preferred embodiment of the method, the load 110 is positioned on a turntable 30 at the wrapping station 20 to facilitate this relative rotation. The turntable 30 also enables the load 110 to be rotated to sequentially orient each corner 112 of the load 110 at a corner board placement position 62, as will be discussed.

The method of the present invention also includes the step of supplying a corner board placer with a corner board. The corner board 120 includes a first portion 121 and a second portion 122 connected along a fold line 124, wherein each of the first and second portions 121,122 has an outer edge 125 generally parallel to the fold line 124. Further in accordance with the invention, if top and bottom caps 114,116 having outwardly extending tabs 115 are provided on the load 110, each of the first and second portions 121,122 of the corner board 120 preferably has a tapered top edge 127 and a tapered bottom edge 129 generally transverse to the fold line 124, such that outer edges 125 are shorter than the fold line 124.

With regard to the configuration of the corner board placer, reference is made to the apparatus described above. The corner board placer 60 can be supplied with a corner board 120, either manually or by an automated process. As seen in FIGS. 4 through 7 and as noted above, the preferred method utilizes a loading station 40 and a picker 50 to automate the step of supplying a corner board 120. Further, either preformed corner boards 120 or corner board blanks 120' may be used in supplying the corner board placer 60 with a corner board 120. In the preferred embodiment, a corner board blank 120' is received by the corner board placer 60, which folds the corner board blank 120' about its fold line 124 to form the corner board 120.

In accordance with the present invention, the corner board that is supplied to the corner board placer is then placed on the corner of the load. Generally, the corner 112 on which the corner board 120 is to placed is oriented at the corner board placement position 62 that corresponds to a corner board placer 60. To perform this step of the invention, and as embodied herein, the corner board 120 preferably is first aligned so the fold line 124 is parallel to and even in elevation with the corresponding corner 112 of the load 110, and the first and second portions 121,122 are spaced from and generally parallel with respective sides 111 of the load 110 that meet along the corner 112. This is performed by a preferred sequence of controlled movements, as shown in FIGS. 11A through 11D.

If top and bottom caps 114,116 are provided on the load 110, the corner board 120 is preferably inserted between the top and bottom caps 114,116 before this alignment occurs. To insert the corner board 120, and in accordance with one aspect of the method of the present invention, the method includes forming an acute angle between the first portion 121 and the second portion 122. In the preferred embodiment, the acute angle is formed by pivoting the pivotally mounted finger members 74 of the carrier 70 described above. Once the acute angle is formed, the method further includes moving the corner board 120 toward the corner 112 until the first and second portions 121,122 have been inserted between the top and bottom caps 114,116 so that the tapered top edges 127 of the first and second portions 121,122 are located directly below the outwardly extending tabs 115 of the top cap 114 and the tapered bottom edges 129 of the first and second portions 121,122 are located directly above the outwardly extending tabs 115 of the bottom cap 116.

The controller 130 and optical sensor system described above control the corner board placer 60 to ensure proper movement of the corner board 120. As seen in FIG. 11B, the corner board 120 preferably is moved toward the corner 112 until the portion of the corner board 120 that is adjacent the pivotally mounted finger members 74 either contacts or is proximate to the respective side 111 of the load 110. This contact or proximity is detected by the at-load sensor 108, which outputs a signal to the controller 130 to control the movement of the corner board 120 accordingly.

After the corner board 120 has been inserted between the top and bottom caps 114,116, the method embodied herein further includes the step of opening the corner board 120 to substantially form a right angle between the first and second portions 121,122, as seen in FIG. 11C. The right angle corresponds to the angle formed at the corner between the respective sides 111 of the load 110. In this manner, the corner board 120 is thus aligned so the fold line 124 is parallel with the corresponding corner 112 of the load 110, and the first and second portions 121,122 are spaced from and generally parallel with respective sides 111 of the load 110 that meet along the corner 112. Preferably, the first and second portions 121,122 are spaced equidistant from the respective sides 111 of the load 110. If top and bottom caps 114,116 are not provided on the load 110, then the corner board 120 is moved into alignment with the corner 112, as seen in FIG. 11C, without first forming the acute angle between the first and second portions 121,122.

Once the corner board 120 is aligned with the corner 112 in the manner discussed above, and in accordance with a separate aspect of the invention, the corner board 120 is placed on the corner 112 of the load 110 by moving the corner board 120 on the corner board placer 60 toward the corner 112 in a direction oblique to the respective sides 111 of the load 110 while maintaining the first and second portions 121,122 generally parallel with the respective sides 111 of the load 110 to simultaneously place the first and second portions 121,122 proximate the respective sides 111 of the load 110. Although it is preferred that the first and second portions 121,122 actually engage the respective sides 111 of the load 110, it is sufficient that each portion is at least proximate the respective side 111 to allow stretch wrap packaging material to be wrapped around the sides 111 of the load 110.

As described in detail above with regard to the preferred embodiment of the apparatus of the present invention, movement of the corner board 120 on the corner board placer 60 toward the corner 112 in a direction oblique to the respective sides 111 of the load 110 is performed by synchronous operation of the universal track drive assembly ball-screws 86. In this manner, the carrier 70 in which the corner board 120 is retained is simultaneously moved along the first set of tracks 82 in the Y direction and along the second set of tracks 84 in the X direction, as controlled by the controller 130. Placement of the corner board 120 on the corner 112 is detected by the at-load sensor 108, and signals are output to the controller 130 accordingly.

In accordance with another aspect of the present invention, the method includes the step of holding the corner board in place on the corner. By holding the corner board in place, the load can be rotated on the turntable to orient a second corner of the load at the corner board placement position of the corner board placer. Hence, and as embodied herein, the method also includes supplying the corner board placer 60 with a second corner board 120, placing the second corner board 120 on the second corner 112 of the load 110, and holding the second corner board 120 on the second corner 112 of the load 110.

In one preferred embodiment of the method, the steps of supplying, placing, and holding a corner board 120 on the load 110 are repeated sequentially until a respective corner board 120 is placed and held on each corner 112 of the load 110. Hence, only a first corner board placer 60 having a first corner board placement position 62 is required. After placing and holding the first and second corner boards 120, as described above, this preferred embodiment of the method then includes rotating the turntable 30 to orient a third corner 112 of the load 110 at the first corner board placement position 62, supplying the first corner board placer 60 with a third corner board 120, placing the third corner board 120 on the third corner 112 of the load 110, and holding the third corner board 120 on the third corner 112 of the load 110. These steps are then repeated to rotate the turntable 30 to orient a fourth corner 112 of the load 110 at the first corner board placement position 62, and then place and hold a fourth corner board 120 on the fourth corner 112 of the load 110.

In another preferred embodiment of the method, two corner board placers are utilized simultaneously to expedite corner board placement and stretch wrapping of the load 110. For example, and as seen in FIG. 1, a first corner board placer 60 having a first corner board placement position 62 is located on one side of the infeed conveyor 34, and a second corner board placer 60' having a second corner board placement position 62 is located on the other side of the infeed conveyor 34. In this manner, a third corner board 120 is placed on a third corner 112 of the load 110 by the second corner board placer 60' while the first corner board 120 is placed on the first corner 112, and a fourth corner board 120 is placed on a fourth corner 112 of the load 110 while the second corner board 120 is placed on the second corner 112.

A restrainer 90 is provided for holding the respective corner boards 120 on the corners of the lead 110. As previously noted, the restrainer 90 preferably includes a top platen 92 having an extendable arm 99, as well as a top restraining device 96 for each side 111 of the lead 110. The restrainer 90 also includes bottom restraining devices 100 located in the turntable 30 at the wrapping station 20. In addition to holding the corner boards 120 against the lead 110, the top and bottom restraining devices 96,100 also are used for folding the outwardly extending tabs 115 of top and bottom caps 114,116 toward the sides of the lead 110.

The method of the present invention also includes dispensing stretch wrap packaging material from the dispenser and providing relative rotation between the lead and the dispenser to wrap the stretch wrap packaging material around the lead with the corner board placed on the corner of the lead. As described in detail above, this step is performed at the wrapping station 20 by rotating the turntable 30. Once wrapping is complete and the stretch wrap packaging material is secured against the lead 110, the restrainer 90 releases the corner boards 120 and the lead 110 is exited from the turntable 30.

As with the apparatus, it is noted that, as recited in the claims, the various aspects of the present invention may be used in combination, or independently, without departing from the scope of the invention.

It will be apparent to those skilled in the art that various modifications and variations can be made in the design and fabrication of the apparatus of the present invention, as well as the sequence and performance of the method of the present invention, without departing from the scope or spirit of the invention.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A method for stretch wrapping a load having sides and corners, comprising:

positioning the load at a wrapping station including a dispenser for dispensing stretch wrap packaging material;

supplying a corner board placer with a corner board having a first portion and a second portion connected along a fold line;

aligning the corner board so the fold line is parallel with a corner of the load and the first and second portions are spaced from and generally parallel with respective sides of the load that meet along the corner;

placing the corner board on the corner of the load by moving the corner board on the corner board placer toward the corner in a direction oblique to the respective sides of the load while maintaining the first and second portions generally parallel with the respective sides of the load to simultaneously place the first and second portions proximate the respective sides of the load; and dispensing stretch wrap packaging material from the dispenser and providing relative rotation between the load and the dispenser to wrap the stretch wrap packaging material around the load with the corner board placed on the corner of the load.

2. A method for stretch wrapping a load having sides and corners, comprising:

positioning the load on a turntable at a wrapping station including a dispenser for dispensing stretch wrap packaging material and orienting a first corner of the load at a first corner board placement position;

supplying a first corner board placer with a first corner board;

placing the first corner board on the first corner of the load;

holding the first corner board on the first corner of the load;

rotating the turntable to orient a second corner of the load at the first corner board placement position;

supplying the first corner board placer with a second corner board;

placing the second corner board on the second corner of the load;

holding the second corner board on the second corner of the load; and dispensing stretch wrap packaging material from the dispenser and rotating the turntable to wrap the stretch wrap packaging material around the load with the corner boards placed on the corners of the load.

3. The method of claim 2 further including:

rotating the turntable to orient a third corner of the load at the first corner board placement position;

supplying the first corner board placer with a third corner board;

placing the third corner board on the third corner of the load;

holding the third corner board on the third corner of the load;

rotating the turntable to orient a fourth corner of the load at the first corner board placement position;

supplying the first corner board placer with a fourth corner board;

placing the fourth corner board on the fourth corner of the load; and holding the fourth corner board on the fourth corner of the load.

4. The method of claim 2 further including:

orienting a third corner of the load at a second corner board placement position while orienting the first corner of the load at the first corner board placement position;

supplying a second corner board placer with a third corner board while supplying the first corner board placer with the first corner board;

placing the third corner board on the third corner while placing the first corner board on the first corner;

holding the third corner board on the third corner;

orienting a fourth corner of the load at the second corner board placement position while orienting the second corner of the load at the first corner board placement position;

supplying the second corner board placer with a fourth corner board while supplying the first corner board placer with the second corner board;

placing the fourth corner board on the fourth corner of the load while placing the second corner board on the second corner of the load; and holding the fourth corner board on the fourth corner of the load.

5. A method for stretch wrapping a load having sides and corners, and top and bottom caps with outwardly extending tabs, comprising:

positioning the load at a wrapping station including a dispenser for dispensing stretch wrap packaging material;

supplying a corner board placer with a corner board having a first portion and a second portion connected along a fold line and having outer edges generally parallel to the fold line, each of the first and second portions having a tapered top edge and a tapered bottom edge generally transverse to the fold line so the outer edges are shorter than the fold line;

forming an acute angle between the first portion and the second portion;

moving the corner board toward the corner until the first and second portions have been inserted between the top and bottom caps so that the tapered top edges of the first and second portions are located directly below the outwardly extending tabs of the top cap and the tapered bottom edges of the first and second portions are located directly above the outwardly extending tabs of the bottom cap;

opening the corner board to substantially form a right angle between the first and second portions;

placing the corner board on the corner between the top and bottom caps with the first and second portions of the corner board placed proximate respective sides of the load; and dispensing stretch wrap packaging material from the dispenser and providing relative rotation between the load and the dispenser to wrap stretch wrap packaging material around the load with the corner board placed on the corner between the top and bottom caps.

6. An apparatus for stretch wrapping a load having sides and corners, comprising:

a wrapping station including a dispenser for dispensing stretch wrap packaging material;

a corner board placer for placing a corner board having a first portion and a second portion connected along a fold line on a corner of the load;

a controller for controlling the corner board placer to place the corner board on the corner of the load by moving the corner board toward the corner in a direction oblique to respective sides of the load that meet along the corner, while maintaining the first and second portions generally parallel with the respective sides of the load, to simultaneously place the first and second portions proximate the respective sides of the load; and means for providing relative rotation between the load and the dispenser to wrap the stretch wrap packaging material around the load with the corner board placed on the corner of the load.

7. An apparatus for stretch wrapping a load having sides and corners, comprising:

a wrapping station including a dispenser for dispensing stretch wrap packaging material and a turntable for rotating the load and providing relative rotation between the load and the dispenser to wrap the stretch wrap packaging material around the load;

a corner board placer for placing a corner board on a corner of the load at a first corner board placement position;

a restrainer for holding the corner board in place on the corner of the load while permitting the load to be rotated by the turntable;

a controller for controlling the corner board placer, the turntable, and the restrainer, to rotate the turntable and sequentially orient a plurality of the corners of the load at the first corner board placement position, place a respective corner board on each of the plurality of the corners of the load at the first corner board placement position, and hold the respective corner boards in place on the plurality of the corners.

8. An apparatus for stretch wrapping a load having sides and corners, and top and bottom caps with outwardly extending tabs, comprising:

a wrapping station including a dispenser for dispensing stretch wrap packaging material;

a corner board placer assembly for placing a corner board on a corner of the load, the corner board having a first portion and a second portion connected along a fold line and outer edges generally parallel to the fold line, each of the first and second portions having a tapered top edge and a tapered bottom edge generally transverse to the fold line so the outer edges are shorter than the fold line, the corner board placer assembly including means for altering an angle formed between the first portion and the second portion;

a controller for controlling the corner board placer to form an acute angle between the first portion and the second portion, move the corner board toward the corner until the first and second portions have been inserted between the top and bottom caps so that the tapered top edges of the first and second portions are located directly below the outwardly extending tabs of the top cap and the tapered bottom edges of the first and second portions are located directly above the outwardly extending tabs of the bottom cap, open the corner board to substantially form a right angle between the first and second portions, and place the corner board on the corner between the top and bottom caps with the first and second portions of the corner board placed proximate respective sides of the load; and means for providing relative rotation between the load and the dispenser to wrap the stretch wrap packaging material around the load with the corner boards placed on the corners of the load.

* * * * *